US006656416B2

(12) United States Patent
Nakamura et al.

(10) Patent No.: US 6,656,416 B2
(45) Date of Patent: Dec. 2, 2003

(54) POWDER FEEDING APPARATUS, PRESSING APPARATUS USING THE SAME, POWDER FEEDING METHOD AND SINTERED MAGNET MANUFACTURING METHOD

(75) Inventors: Akira Nakamura, Ibaraki (JP); Atsuo Tanaka, Hyogo-ken (JP); Shouichi Matsugami, Hyogo-ken (JP); Tadahiro Iwasaki, Hyogo-ken (JP); Yoshiro Takano, Takatsuki (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/946,962

(22) Filed: Sep. 6, 2001

(65) Prior Publication Data

US 2002/0051726 A1 May 2, 2002

(30) Foreign Application Priority Data

Sep. 12, 2000 (JP) ..... 2000-276508
Jan. 29, 2001 (JP) ..... 2001-020785

(51) Int. Cl.[7] ..... B22F 3/12
(52) U.S. Cl. ..... 419/38; 425/78
(58) Field of Search ..... 419/38; 425/78

(56) References Cited

U.S. PATENT DOCUMENTS 6,299,832 B1 * 10/2001 Kohara et al. ..... 419/38
6,481,993 B1 * 11/2002 Kohara et al. ..... 425/78

FOREIGN PATENT DOCUMENTS

| | | |
|---|---|---|
| JP | 59-32568 | 9/1984 |
| JP | 59-40560 | 10/1984 |
| JP | 61-147802 | 7/1986 |
| JP | 6-136403 | 5/1994 |
| JP | 11-49101 | 2/1999 |
| JP | 2000-248301 | 9/2000 |

* cited by examiner

*Primary Examiner*—Daniel J. Jenkins
(74) *Attorney, Agent, or Firm*—Armstrong, Westerman & Hattori, LLP

(57) ABSTRACT

A powder pressing apparatus comprises a powder feeding apparatus. The powder feeding apparatus includes a container having a bottom portion provided with a powder holding portion formed with openings, and an impactor. The impactor is hit against the container to give an impulsive force, thereby feeding the powder contained in the container into the cavity formed in a die via the openings. The powder fed in the cavity is pressed, and the obtained compact is sintered into a sintered magnet. The powder feeding apparatus may include a feeder box containing the powder, and the feeder box may be provided therein with a rod member, and an opening of the feeder box may be provided with a linear member. In this case, the powder is fed into the cavity while moving the rod member in the horizontal direction in the feeder box, when the feeder box is above the cavity.

25 Claims, 22 Drawing Sheets

10

| | Br (T) | (BH)max (kJ/m$^3$) |
|---|---|---|
| Sintered Magnet made by using Conventional Apparatus | 1.37 | 366.2 |
| | 1.37 | 366.3 |
| Sintered Magnet made by using Pressing Apparatus 100 | 1.38 | 370.1 |
| | 1.38 | 369.5 |

Conventional Powder Feeding Apparatus

Powder Feeding Apparatus in Fig. 10

Comparison of Weight Distribution

POWDER FEEDING APPARATUS, PRESSING APPARATUS USING THE SAME, POWDER FEEDING METHOD AND SINTERED MAGNET MANUFACTURING METHOD

BACKGROUND OF THE INVENTION

1. Field of the Invention

The present invention relates to a powder feeding apparatus, a pressing apparatus using the same, a powder feeding method and a sintered magnet manufacturing method. More specifically, the present invention relates to a powder feeding apparatus for feeding a powder into a cavity formed in a die, a pressing apparatus using the same, a powder feeding method and a sintered magnet manufacturing method.

2. Description of the Related Art

Currently, as sintered rear-earth alloy magnets, two kinds, i.e. a samarium-cobalt magnet and a rare-earth-iron-boron magnet, are used extensively in many fields. Of the two, the rare-earth-iron-boron magnet is appreciated in application to variety of electronic devices and apparatuses. (Hereinafter, the rare-earth-iron-boron magnet will be called "R-T-(M)-B magnet", where R represents a rare-earth element including yttrium, T represents iron or iron partially substituted by a transition metal element, M represents a doped element, and B represents boron.) A reason for this is that the R-T-(M)-B magnet is the most superior of many kinds of magnets in terms of magnetic energy product and relatively inexpensive in terms of price. The transition metal included as T may be cobalt for example. Boron can be partially substituted by carbon.

In manufacture of such a rare-earth magnet, first, a magnetic alloy powder made by milling a rare-earth alloy is pressed into a compact (green compact) by a pressing apparatus. When making the compact, the magnetic alloy powder is fed into a cavity formed by a die hole (through hole) provided in a die and a lower punch inserted into the die. The magnetic alloy powder fed in the cavity is pressed by an upper punch. The compact thus obtained is then sintered at a temperature of 1000° C. –1100° C. approx., and then finished as the sintered rare-earth magnet.

Conventionally, a variety of methods are proposed for feeding the magnetic alloy powder into the cavity in the pressing apparatus.

For example, Japanese Utility Model Publication (of examined Application for opposition) No. 59-32568 and Japanese Patent Laid-Open No. 61-147802 each discloses a technique of vibrating a container which holds the powder and thereby supplying the power into the cavity in sieving action through a metal net.

According to Japanese Patent Laid-Open No. 61-147802, there is described an apparatus comprising a feeder cup (the powder container) having a bottom portion provided with a metal net. The feeder cup is vibrated relatively rigorously by using a solenoid coil, thereby feeding the granular magnetic powder through the metal net into the cavity in a short time.

However, according to the conventional apparatus disclosed in Japanese Patent Laid-Open No. 61-147802, the vibration is generated by means of attracting force between the solenoid coil and an iron core, and of restoring force provided by a spring, and the vibration is given to the feeder cup itself which holds the powder. The iron core (moving part) is fastened to the feeder cup by a connecting hardware. With this arrangement, the vibrating force transmitted to the powder in the feeder cup is only a reciprocating force, and the transmitted force is still not sufficient to break down a lump of powder. In such an apparatus, in order to supply the granular powder into the cavity while preventing bridge formation, one possibility is to use the metal net having a fine grid (mesh). However, use of such a fine-mesh metal net poses another problem that the powder is not quickly sieved and there is a significant increase in the time for feeding the powder.

Another problem with the above conventional apparatus is that it is difficult to increase the stroke (amplitude) of vibration given to the feeder cup. If the feeder cup is moved only in a short stroke, it is difficult to feed the powder uniformly in the cavity.

There is still another problem. Specifically, corner and/or edge regions of the cavity is more difficult to feed with the powder than a center region of the cavity. According to the conventional apparatus therefore, when the rare-earth alloy powder is supplied through the metal net which is provided at a position relatively high above the die surface, the powder tends to form a high portion in the center region. If the powder is fed in such a non-uniform density in the cavity, the compact formed by the pressing operation has an unacceptably large difference in its pressing density, between the corner and/or edge regions and the center region. This density difference can cause a crack in the compact.

This problem is presumable also in an apparatus disclosed in Japanese Utility Model Publication (of examined Application for opposition) No. 59-32568.

Other techniques for feeding the powder into the cavity are proposed in Japanese Patent Laid-Open No. 11-49101 and Japanese Patent Laid-Open No. 2000-248301.

According to the technique disclosed in Japanese Patent Laid-Open No. 11-49101, a feed is fed into a container by means of pneumatic tapping and via a supplying hopper. An arrangement is made so that the feed is present in both of the supplying hopper and the container after the pneumatic tapping. Then, of this mass of the feed present in both of the supplying hopper and the container, a portion of uniform density formed in the container is separated from the feed remaining in the supplying hopper.

Japanese Patent Laid-Open No. 2000-248301 discloses a supplying apparatus, in which a feeder box having an opening in a bottom is moved to above a cavity formed in a die tooling, allowing a rare-earth alloy powder to be supplied into the cavity from the opening. The supplying apparatus comprises rod members which are moved at the bottom portion horizontally within the feeder box. The rod members are reciprocated when the rare-earth alloy powder in the feeder box is supplied to the cavity.

However, according to the technique disclosed in Japanese Patent Laid-Open No. 11-49101, since the feeding into the container is performed by the pneumatic tapping, the feeding density of the feed in the container becomes higher than by means of natural gravitational fall. For example, a rare-earth alloy powder fed by means of natural gravitational fall has the feeding density of 1.8 g/cm$^3$ approx., versus the feeding density of 3.4 g/cm$^3$ approx. by means of pneumatic tapping. The feed packed to such a high density does not allow particles of the powder to move easily, requiring a stronger magnetic field in order to orient the powder, leading to increase in manufacturing cost.

According to the technique disclosed in Japanese Patent Laid-Open No. 2000-248301 on the other hand, as shown in FIG. 21A, a feeder box 2 is moved toward a cavity 1. Then, as shown in FIG. 21B, when the feeder box 2 is positioned above the cavity 1, a powder 3 is supplied into the cavity 1 by the weight of the powder 3 itself. The feeding thus performed is not even, and therefore the powder 3 is not distributed uniformly. Thereafter, as shown in FIG. 21C and FIG. 21D, a shaker 4 is activated to fill the cavity 1 with the powder 3. The shaker 4 forces the powder 3 in, to the density of 2.3 g/cm$^3$ approx., thereby uniformalizing the feeding density. As a result, a stronger magnetic field is necessary in order to obtain a desired level of orientation. FIG. 22 shows state changes in the feeding operation performed by this conventional apparatus.

Further, if the cavity is shallow in a direction of the pressing operation provided by the punches, the feeding density inconsistency in the cavity is not easily corrected by the pressing operation, leading to occasional crack development in the compact.

SUMMARY OF THE INVENTION

It is therefore a primary object of the present invention to provide a powder feeding apparatus, a pressing apparatus using the same and a sintered magnet manufacturing method, capable of feeding the powder uniformly and in a short time into the cavity of the pressing apparatus.

Another object of the present invention is to provide a powder feeding apparatus, a pressing apparatus using the same, a powder feeding method and a sintered magnet manufacturing method, capable of providing a desired orientation and a high magnetic characteristic at a low cost.

According to an aspect of the present invention, there is provided a powder feeding apparatus for feeding a powder into a cavity formed in a die, comprising: a container including a bottom portion provided with a powder holding portion formed with a plurality of openings capable of allowing the powder to pass through; and an impactor capable of hitting against the container; wherein the impactor is hit against the container to give an impulsive force to the container, thereby feeding the powder contained in the container into the cavity via the openings.

According to this invention, by having the impactor hit against the container, a lump of the powder contained in the container can be broken down and the powder in the broken state can be supplied into the cavity.

According to another aspect of the present invention, there is provided a pressing apparatus comprising: the above described powder feeding apparatus; and pressing means which presses the powder fed in the cavity by the powder feeding apparatus.

According to still another aspect of the present invention, there is provided a sintered magnet manufacturing method comprising: a first step of applying an impulsive force to a container which includes a bottom portion provided with a powder holding portion formed with a plurality of openings capable of allowing the powder to pass through, thereby feeding the powder contained in the container via the openings into a cavity formed in a die; a second step of forming a compact by pressing the powder fed in the cavity; and a third step of manufacturing a sintered magnet by sintering the compact.

By pressing the powder which is fed uniformly in the cavity, a compact which has a uniform density, and a small inconsistency in size and weight can be manufactured.

Further, by sintering the compact, a magnet which has a small inconsistency in size and weight can be obtained.

Preferably, the apparatus further comprises a vibrating mechanism connected to an upper portion of the container. The impactor is provided so as to hit against a lower portion of the container, and the vibrating mechanism vibrates an upper portion of the container, thereby allowing the impactor to hit against the lower portion of the container. In this way, by connecting the vibration mechanism with the container and by separating the impactor from the vibration mechanism, it becomes possible to reduce whirling up of the powder, thereby reducing binding of the powder in the vibrating mechanism. Further, by hitting the impactor on the lower portion of the container, the impact can be transmitted more directly to the opening of the container, making possible to transmit the impact to the entire mass of the powder present at the opening, thereby feeding the cavity with the powder uniformly.

Further, preferably, the powder holding portion is formed of a net having a mesh size of 2–14. More preferably, the powder holding portion is formed of a net having a mesh size of 2–8. By using a relatively coarse net as the above, the powder can be fed uniformly into the cavity while remarkably reducing the time necessary for the powder feeding.

Preferably, the powder holding portion is provided at a height smaller than 2.0 mm from a surface of the die. More preferably, the powder holding portion is provided at a height smaller than 1.0 mm from the surface of the die. This arrangement makes possible to allow only a small amount of the powder to project from within the cavity above the surface of the die. Therefore, an amount of the extra powder to be wiped is small, and a lump produced in the wiping operation by the container is not unwontedly fed into the cavity at the next cycle of powder feeding.

Further, preferably, the container can move when the impulsive force is given to the container by the hitting of the impactor against the container. With this arrangement, it becomes possible to have the moving container be hit by the impactor, and to give a reverse impact to the container, and therefore to feed the cavity with the powder more uniformly.

Preferably, the apparatus comprises a plurality of the impactors disposed outside of the container in an opposing relationship, with the container in between. With this arrangement, the impulsive force can be given continuously to the container.

Further, preferably, the apparatus further comprises a partition plate provided inside the container. With this arrangement, when the impactor hits a side wall of the container, the impulsive force can be transmitted dispersively to the powder inside the partitioned container, making possible to feed the powder more efficiently. This arrangement can remarkably reduce feeding time of the powder into the cavity.

Further, preferably, a size of the openings provided in the powder holding portion is in accordance with a location of the opening. By changing the coarseness according to the location of the opening in this way, the amount of powder to be fed into the cavities can be controlled according to region.

If the powder is a rare-earth alloy powder, the powder particles are angular, and with addition of a lubricant, the powder decreases its flowability and forms a lump, into a state not to easily drop from the opening of the powder holding portion. However, according to the present invention, even if the powder is a rare-earth alloy powder mixed with a lubricant and poor in flowability, the powder can be fed in the cavity uniformly and efficiently in a short time.

According to another aspect of the present invention, there is provided a powder feeding apparatus for feeding a powder into a cavity formed in a die, comprising: a feeder box movable to above the cavity, including a bottom portion formed with an opening, and containing the powder; a rod member provided inside the feeder box and pushing the powder downwardly; a linear member provided at the opening of the feeder box; and orienting means which aligns the powder fed from the feeder box in the cavity.

According to still another aspect of the present invention, there is provided a powder feeding method for feeding a powder into a cavity formed in a die, the method comprising: a step of moving a feeder box to above the cavity of the die, with the feeder box containing the powder, being provided inside thereof with a rod member movable in a horizontal direction, and having an opening provided with a linear member; a step of feeding the powder into the cavity while moving the rod member in the horizontal direction within the feeder box, when the feeder box is above the cavity; and a step of orienting the powder by applying a magnetic field to the powder in the cavity.

According to this invention, by providing the linear member at the opening of the feeder box, the powder does not fall into the cavity even when the feeder box has moved to above the cavity. The powder can be fed into the cavity thereafter, by activating the rod member in the feeder box. In this feeding, the powder can be fed into the cavity uniformly at a natural feeding density (1.7 g/cm$^3$–2.0 g/cm$^3$ for example). Since the powder is not fed at a high density, the powder particles can move easily, and a desired orientation can be achieved by an orienting magnetic field of a relatively low strength. This makes possible to prevent manufacturing cost from increasing. Further, since the density distribution in the feeding can be made uniformly, a product having a superb magnetic characteristic can be obtained by orienting the powder in the cavity.

Preferably, the rod member is spaced from the linear member by a distance not smaller than 0.5 mm and not greater than 10 mm. With this arrangement, flow of the powder near the linear member is assisted, making possible to smoothly feed the powder into the cavity at a density suitable for the orientation.

According to still anther aspect of the present invention, there is provided a pressing apparatus comprising: the powder feeding apparatus described above; and pressing means which presses the powder fed in the cavity by the powder feeding apparatus.

According to this invention, by pressing the powder which is fed in the cavity by the above powder feeding apparatus, a compact high in density uniformity can be obtained, and thus crack and fracture development due to inconsistent density can be prevented.

If the powder is produced by using a rapid quenching process, and a particle distribution pattern of the powder is made narrow, the powder has an extremely poor flow ability. However, according to the present invention, since the powder flowablity can be improved by the natural gravitational feeding, density consistency of the powder in the cavity can be improved even if the powder is produced by using the rapid quenching process and the particle distribution pattern of the powder is made sharp. Further, each powder particle can be easily moved, and therefore it becomes possible to form a magnet having a high magnetic anisotropy for example.

Preferably, the interval between the linear members is not smaller than 2 mm and not greater than 12 mm.

According to still anther aspect of the present invention, there is provided a sintered magnet manufacturing method comprising: a step of obtaining a compact by pressing a powder in a cavity, the powder being fed by the above described powder feeding method; and a step of manufacturing a sintered magnet by sintering the compact.

According to this invention, by pressing the powder fed into the cavity by means of the above described method, a compact high in density uniformity can be obtained, and thus crack and fracture development in the compact can be reduced. As a result, sintered magnet obtained by sintering the compact has a decreased rate of defects due to cracking and/or fracturing, and a decreased rate of deformation. Therefore, it becomes possible to improve yield in manufacturing process, to improve productivity of the sintered magnet, and to manufacture a sintered magnet having a favorable magnetic characteristic.

The above objects, other objects, characteristics, aspects and advantages of the present invention will become clearer from the following description of embodiments to be presented with reference to the accompanying drawings.

BRIEF DESCRIPTION OF THE DRAWINGS

FIG. 2A is a plan view with a lid removed, whereas FIG. 2B is a sectional view with a powder present;

FIG. 3A illustrates a state before applying the impact force, whereas FIG. 3B illustrates a state right after the application of the impact force;

FIG. 9A is a plan view with a lid removed, whereas FIG. 9B is a sectional view with a powder present;

FIG. 17A is a view showing a compact formed in an experiment, whereas FIG. 17B is a table showing a result of the experiment;

DETAILED DESCRIPTION OF THE PREFERRED EMBODIMENTS

Hereinafter, embodiments of the present invention will be described with reference to the drawings.

Figure 1:
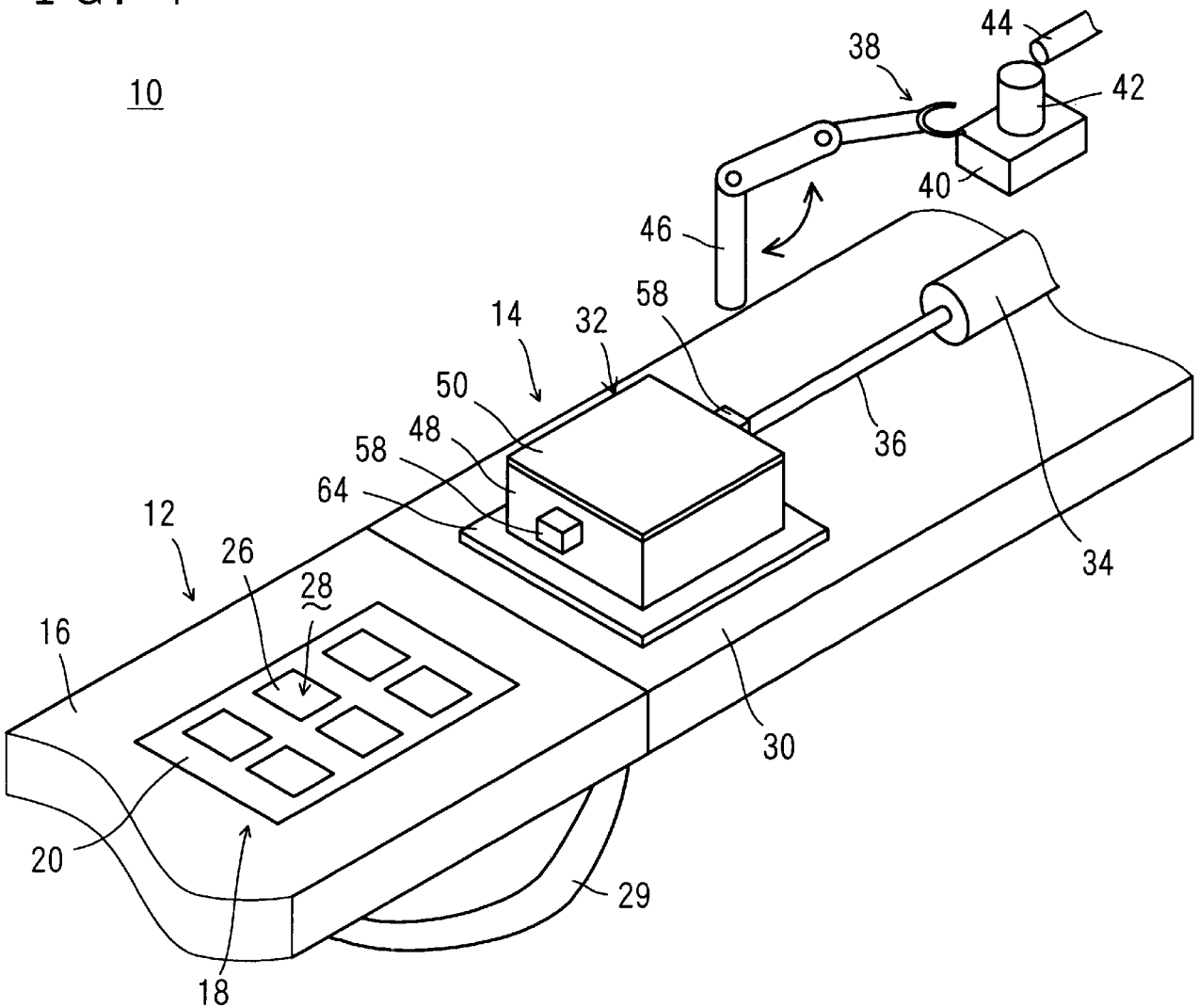
FIG. 1 is a perspective view showing a principal portion of a pressing apparatus as an embodiment of the present invention.

Referring to FIG. 1 and FIG. 2, a powder pressing apparatus 10 as an embodiment of the present invention comprises a pressing portion 12 and a powder feeding apparatus 14.

The pressing portion 12 includes a die set 16 and a die tooling 18. The die tooling 18 includes a die 20, lower punches 22 and upper punches 24 (See FIG. 6). The die 20 has a saturated magnetism not smaller than 0.05 T and not greater than 1.2 T for example. The die 20 is fitted into the die set 16. Each of the lower punches 22 is disposed so as to be inserted into a die hole 26 from below. The die hole 26 is a through hole running vertically through the die 20. An upper end surface of the lower punch 22 and an inner circumferential surface of the die hole 26 provide a cavity 28 (See FIG. 2B) of a variable volume. With this arrangement, the upper punch 24 is inserted into the cavity 28 to press a powder m (to be described later) fed in the cavity 28 into a compact. Further,a magnetic field generating coil 29 is provided near the die 20. By using the coil 29 for generation of magnetic field, an orienting magnetic field, having a strength of 1.2 T for example, is applied to the powder m in parallel with the pressing direction.

The powder feeding apparatus 14 includes a base plate 30 disposed in abutment on the die set 16. On the base plate 30, a feeder box 32 is disposed. The feeder box 32 is moved by a cylinder rod 36 of a cylinder 34 which is driven hydraulically or pneumatically for example (or by an electric servo motor), in a reciprocating pattern between a predetermined position on the die 20 and a stand-by position. Near the stand-by position of the feeder box 32, there is provided a replenishing apparatus 38 for replenishing the feeder box 32 with the powder m.

The replenishing apparatus 38 includes a weighing scale 40, a feeder cup 42 disposed thereon, and a vibrating trough 44 which drops the powder m by a small amount into the feeder cup 42. The weighing operation is performed while the feeder box 32 is moved onto the die 20. When the weight of the powder m in the feeder cup 42 reaches a predetermined level, a robot 46 grasps the feeder cup 42, and when the feeder box 32 returns the stand-by position, the robot 46 replenishes the feeder box 32 with the powder m in the feeder cup 42. The amount of the powder m in the feeder cup 42 replenishes an amount of the powder in the feeder box 32 used in a cycle of pressing operation. Therefore, the feeder box 32 holds a constant amount of the powder m. Because of the constancy in the amount of the powder m held in the feeder box 32, pressure in gravitational fall of the powder m into the cavity 28 is constant, and an amount of the powder m fed into the cavity 28 is constant. The powder m may be a rare-earth alloy powder for example.

Figure 2A:
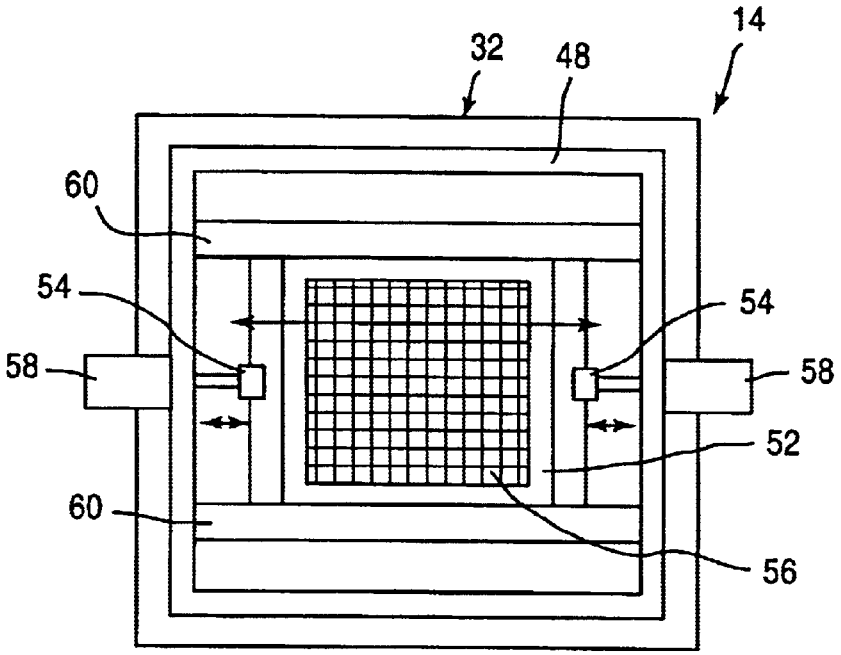
FIG. 2A and FIG. 2B are views showing a principal portion of a powder feeding apparatus used in the embodiment in FIG. 1.
Figure 2B:
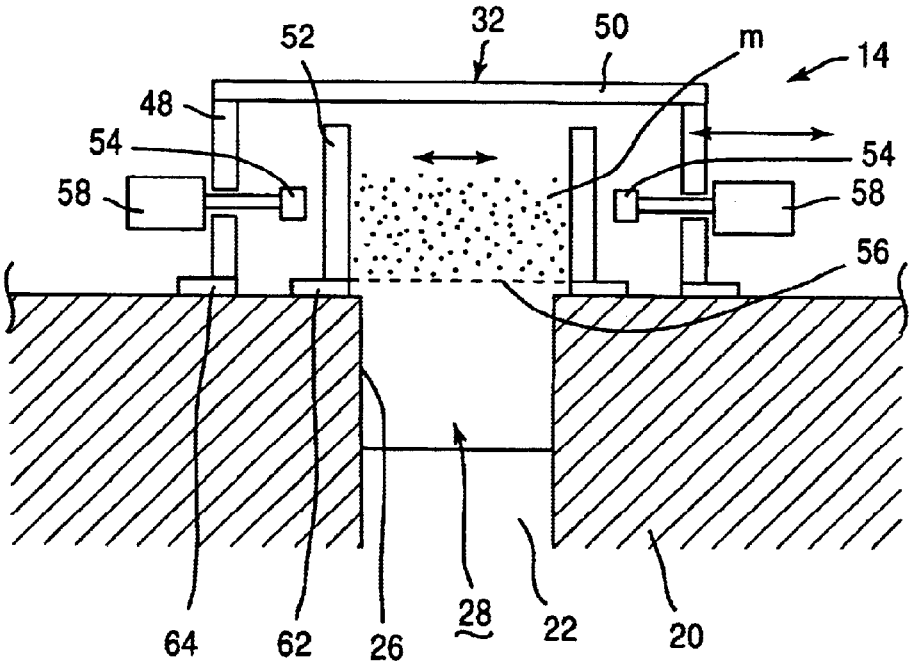

Reference is now made to FIG. 2A and FIG. 2B, and description will be made for a principal portion of the powder feeding apparatus 14.

The feeder box 32 of the powder feeding apparatus 14 includes an enclosing member 48 and a lid 50 which is disposed on an upper surface of the enclosing member 48 and can be opened and closed. Inside the enclosing member 48, a powder container 52 is disposed. The powder container 52 is disposed between a pair of opposed impactors 54. The feeder box 32, with the powder container 52 containing the powder m, is moved to above the cavity 28 formed in the die 20 of the pressing apparatus 10, allowing the powder m to be supplied into the cavity 28.

The lid 50 provided on the upper surface of the enclosing member 48 can seal the inside of the enclosing member 48. Preferably, inside the enclosing member 48 an inert gas such as nitrogen gas is supplied, preventing the powder m contained in the powder container 52 from oxidization by the atmosphere. The lid 50 can be opened and closed automatically by an air cylinder for example.

The powder container 52 has a bottom portion provided with a net member 56 which is capable of holding the powder m and of allowing the powder m to pass through upon impact from the impactor 54. Preferably, the net member 56 is made of a stainless steel such as SUS 304, and has a mesh size of 2–14 (sieve aperture not smaller than 1.8 mm and not greater than 12.7 mm). More preferably, the mesh size is 2–8 (sieve aperture not smaller than 3.2 mm and not greater than 12.7 mm). For example, the net member of a mesh size of 8 can be made of a metal wire having 0.6 mm diameter weaved into a net having 3.0 mm grids. The net member 56 preferably is plated with nickel for example. This decreases surface coarseness of the net member 56, making possible to improve flowability of the rare-earth alloy powder at the time of feeding.

Each of the impactors 54 is provided with and driven by an air cylinder 58, independently of the other. The impactor 54 can be moved quickly by the air cylinder 58 toward the powder container 52, to hit on a side wall of the powder container 52 thereby applying an impulsive force (an impacting force). By this impact, the powder m contained in the powder container 52 is supplied into the cavity 28 through the net member 56. Preferably, the impactors 54 are driven by the air cylinders 58 to hit the powder container 52 at a rate of 50–120 times per minute. Each of the impactors 54 has a reciprocating stroke of 10 mm–20 mm for example.

Preferably, upon impact from one of the impactors 54, the powder container 52 can move toward the other impactor 54. In order to allow this, the enclosing member 48 is provided with a pair of guide members 60 extending in parallel with each other in the direction in which the impactors 54 are moved. The powder container 52 can move linearly in the enclosing member 48 along the guide members 60. With this arrangement, the other impactor 54 can be hit against the approaching powder container 52, and it becomes possible to give the powder container 52 an impact in the reverse direction of the direction of the container movement. This makes possible to feed the powder m in the cavity 28 uniformly.

The powder container 52 has a bottom edge provided with a sliding member 62 (thickness: 5 mm approx. for example)

made of such material as a thin plate of fluororesin or felt. The sliding member 62 reduces chance for the powder m to be caught between the powder container 52 and the die 20, making possible for the powder container 52 to slide smoothly on the die 20. A similar sliding member 64 is provided at a bottom edge of the enclosing member 48. The sliding member 64 reduces chance for the powder m to be caught between the enclosing member 48 and the die 20, making possible for the enclosing member 48 to slide smoothly on the die 20. With these arrangements, the feeder box 32 can slide smoothly on the die 20 of the pressing apparatus 10.

Figure 3A:
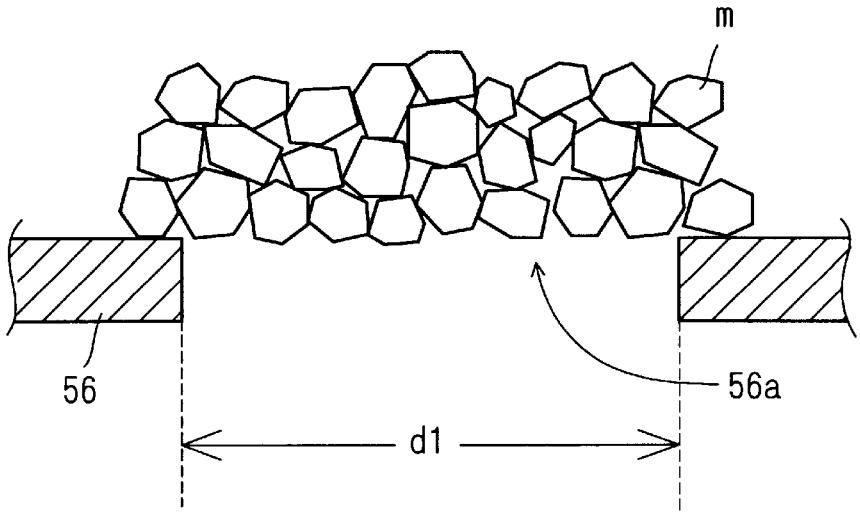
FIG. 3A and FIG. 3B are sectional views showing a fall of the powder from a net member caused by an impact force.
Figure 3B:
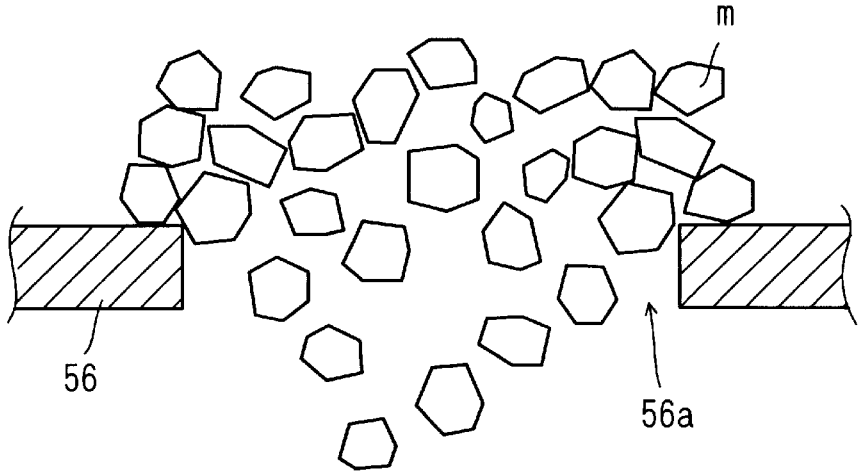

Next, reference is made to FIG. 3A and FIG. 3B. FIG. 3A shows a state before the impactor 54 gives an impact. If the powder m is a rare-earth alloy powder produced by using a strip cast process, each powder particle is angular. Further, if a lubricant is added to the powder m, the powder m decreases in its flowability and forms a lump. In this case, the powder m, i.e. the rare-earth alloy powder, is in a state not to easily drop from the opening 56*a* (grid) of the net member 56. For this reason, the net member has a relatively coarse grid of 2–14 mesh approx., with the opening 56*a* having a relatively large width (gap) d1, which is a few millimeters through ten plus a few millimeters.

Thereafter, as shown in FIG. 3B, the impact is given by the impactor 54, to break up the lump, allowing the powder m or particles smaller than the mesh to fall through the opening 56*a* of the net member 56. A note should be made here that in FIG. 3A and FIG. 3B, the illustrated particles of the powder m are relatively oversized. In reality however, the particle of the powder m provided by a rare-earth alloy powder typically has a diameter not greater than 10 $\mu$m, which is by far smaller than the width d1 (a few millimeter through a ten plus a few millimeter) of the opening 56*a*.

As has been described, according to the present embodiment, unlike the prior art in which the container itself is vibrated, the impactors 54 are hit against the powder container 52 as shown in FIG. 2A and FIG. 2B. This makes possible to break down the powder m, which is poor in flowablity and subject to lump formation in the powder container 52, and to supply the cavity 28 with the powder m under a broken state. Use of the impactors 54 makes possible to apply the powder container 52 with a very large force which acts in a significantly short period of time (instantaneous force), which transmits to the powder m and effectively breaks the lump of powder m into finer state. According to the present embodiment, by using a relatively coarse net of 2–14 mesh size approx., it becomes possible to uniformly feed the powder m in the cavity 28 in a remarkably reduced time.

Figure 4:
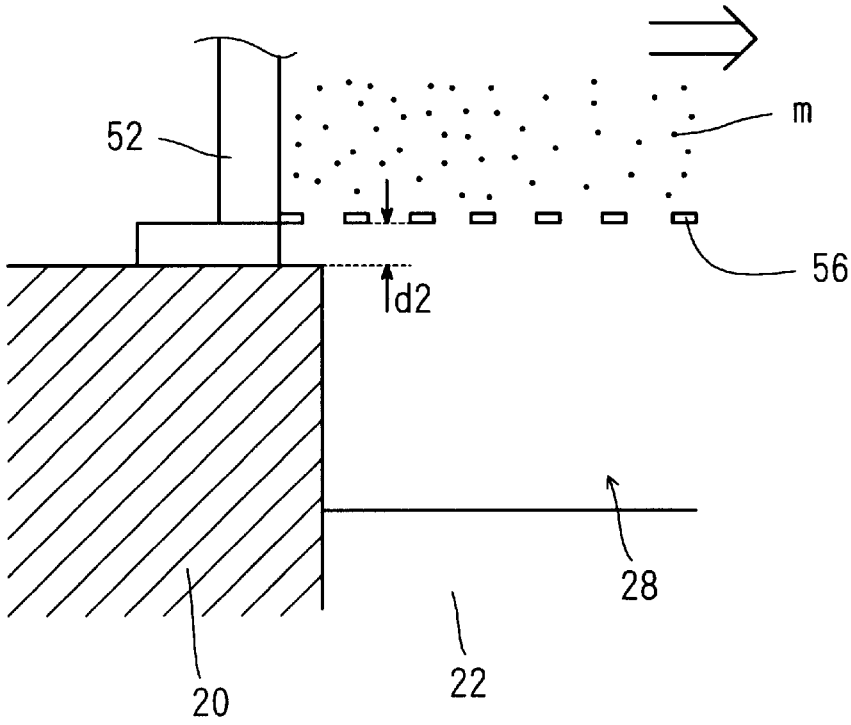
FIG. 4 is an enlarged sectional view of a part of a powder container for illustrating a gap between a die surface and the net member.

Next, reference is made to FIG. 4. According to the powder feeding apparatus 14, after supplying the cavity 28 with the powder m, and when the feeder box 32 is moving away from above the cavity 28, a bottom edge of the powder container 52 wipes a top portion of the fed powder. This makes possible to accurately feed a predetermined amount of powder m which is to be pressed into compact, into the cavity 28. In order to properly adjust the amount of the powder by the wiping operation, the net member 56 is attached closely to the surface of the die 20, at the bottom portion of the powder container 52. The net member 56 is spaced from the surface of the die 20 by a distance d2, which is preferably smaller than 2 mm, and more preferably smaller than 1 mm.

If the gap d2 between the net member 56 and the surface of the die 20 is small as described, only a small amount of the powder m is allowed to project from within the cavity 28 above the upper surface of the die 20. Therefore, an amount of the extra powder m to be wiped is small, and a lump of the powder resulting from the wiping operation by the powder container 52 is not fed into the cavity 28 in the next cycle of powder feeding. Further, it becomes possible to reduce an amount of powder m dropped between the surface of the die 20 and the net member 56 in a region other than the cavity 28, making possible to prevent this extra amount of powder m from being fed (pushed) into the cavity 28 at the time of wiping. Further, even if the cavity 28 has corner and/or edge regions which are difficult to supply with the powder m as compared with a cavity center region, it is possible to prevent the powder m from projecting in the center region (i.e. to prevent extra amount of powder from being fed), and to uniformly feed the powder m in the corner and/or edge regions of the cavity 28 up to the surface of the die 20.

As has been described, by attaching the net member 56 closely to the surface of the die 20, it becomes possible to feed the powder m uniformly in the cavity 28. It should be noted here that if the net member 56 is provided closely to the surface of the die 20 as described above, in order to prevent the net member 56 from contacting the surface of the die 20, it is preferable that the net member 56 does not easily sag down. For this reason, the net member 56 is preferably made of a rolled mesh which is not distorted easily.

Figure 5:
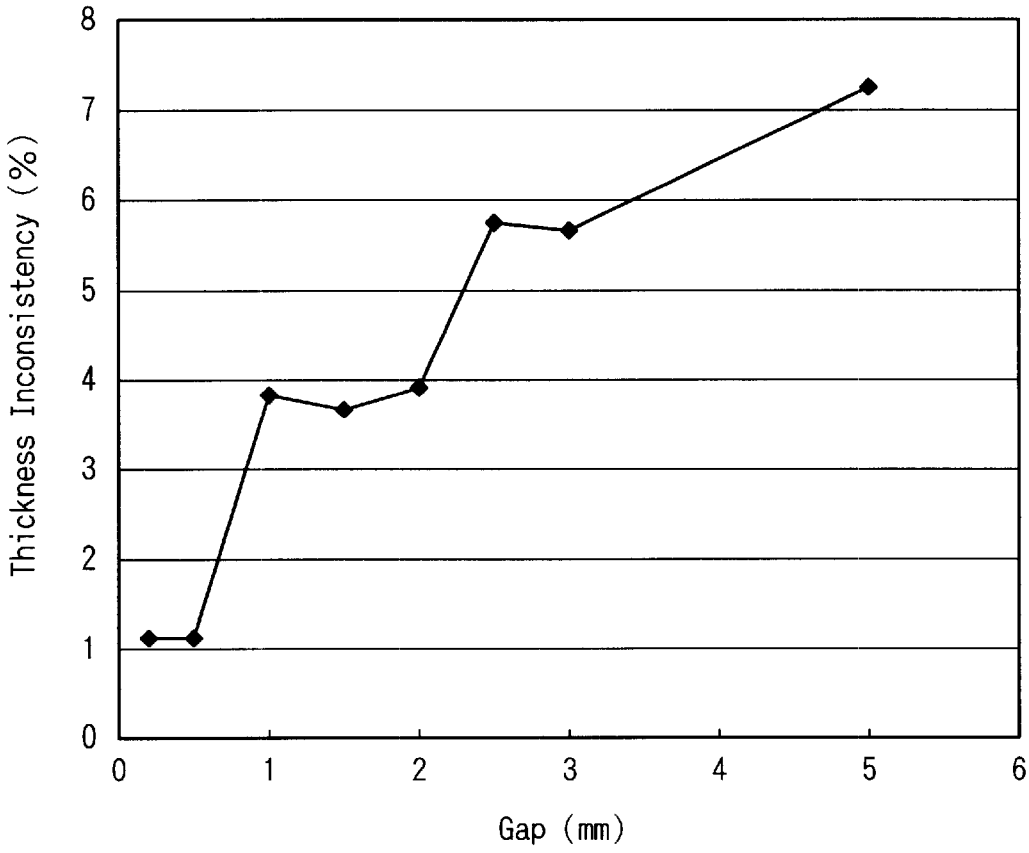
FIG. 5 is a graph showing a relationship of the gap between the die surface and the net member with a thickness inconsistency.

FIG. 5 is a graph showing a relationship of the distance (gap) d2 between the net member 56 and the surface of die 20 with thickness inconsistency of the sintered compact (sintered body). The thickness inconsistency was measured as follows: First, block-like compacts each having a size of 55 mm width, 45 mm length and 16 mm height were manufactured by the pressing apparatus 10. The compacts were then sintered, and then thickness measurements were made at a total of five locations, i.e. four locations near respective corners as well as one center location, on an upper surface of the sintered body. The thickness inconsistency (percent) was calculated by dividing a difference between a maximum measurement and a minimum measurement of the five measurements, by an average of the five measurements. For each setting of the gap d2, the thickness inconsistency was obtained for thirty sintered bodies, an average of which is then plotted on the graph as the thickness inconsistency (percent) at each particular gap d2.

As understood from the graph, the thickness inconsistency could be reduced to not greater than 4% when the gap d2 is smaller than 2 mm, and compacts of a desired shape having a relatively uniform thickness could be manufactured. Also, it was learned from the graph that in order to reliably manufacture a compact having a small thickness inconsistency, the gap d2 should preferably be smaller than 1 mm, and further, if the gap d2 is set to not greater than 0.5 mm, it becomes possible to manufacture a highly accurate sintered body having a remarkably reduced thickness inconsistency.

As has been described, in the powder feeding apparatus 14 according to the present embodiment, the impactors 54 provide impulsive force to break down the lump of powder m in the powder container 52, and to allow the powder m to be supplied into the cavity 28 through the relatively coarse net member 56 provided closely to the surface of the die 20, whereby it became possible to feed the powder m uniformly regardless of the depth or region in the cavity 28. Further, it became possible to remarkably reduce the time necessary for the powder supply. The powder feeding apparatus 14 according to the present embodiment was applied to the feeding operation of a rare-earth alloy powder which had poor flowability due to addition of a lubricant made of raw material to be described later, and was found to have a significant effect. Further, the effect was particularly remarkable when the depth of the cavity 28 to which the powder m was fed was not greater than 30 mm.

Now, description will cover an operation of the pressing apparatus 10.

An inert gas such as nitrogen gas is supplied to the powder container 52 in the feeder box 32. Under this state, the lid 50 of the feeder box 32 is opened, and the robot 46 supplies the powder container 52 with a predetermined amount of powder m measured in the feeder cup 42. After supplying the powder m, the lid 50 is closed so as to maintain the inside of the powder container 52 filled with the inert gas. The supply of the inert gas into the powder container 52 is continuous, not only when the feeder box 32 is moving above the cavity 28, in order to prevent the powder from catching fire. The inert gas may alternatively be argon or helium gas.

Under the above condition, the feeder box 32 containing the powder m is moved to above the cavity 28, and then the powder supply is performed. As shown in FIG. 2A and FIG. 2B, the powder supply is performed by driving the air cylinders 58 connected with the impactors 54 thereby applying impulsive force to the powder container 52. By using the impactors 54 and thereby applying the impact multiple times continually, the powder m contained in the powder container 52 is supplied into the cavity 28 through the net member 56.

A hitting pattern of the impactors 54 can be varied in many ways. For example, the pattern may be that the left impactor 54 hits the powder container 52 whereupon the right impactor 54 leaves the powder container 52, and then the right impactor 54 hits the powder container 52 whereupon the left impactor 54 leaves the powder container 52. Along with the hitting action, it is preferable that the powder container 52 is allowed to reciprocate on the die 20, so that the powder container 52 itself is finely vibrated. By providing the impactors 54 to oppose each other, on the left and right sides, it becomes possible to supply the powder m into the cavity 28 in an appropriate hitting pattern that allows the powder m to easily enter the cavity 28 uniformly.

Figure 6:
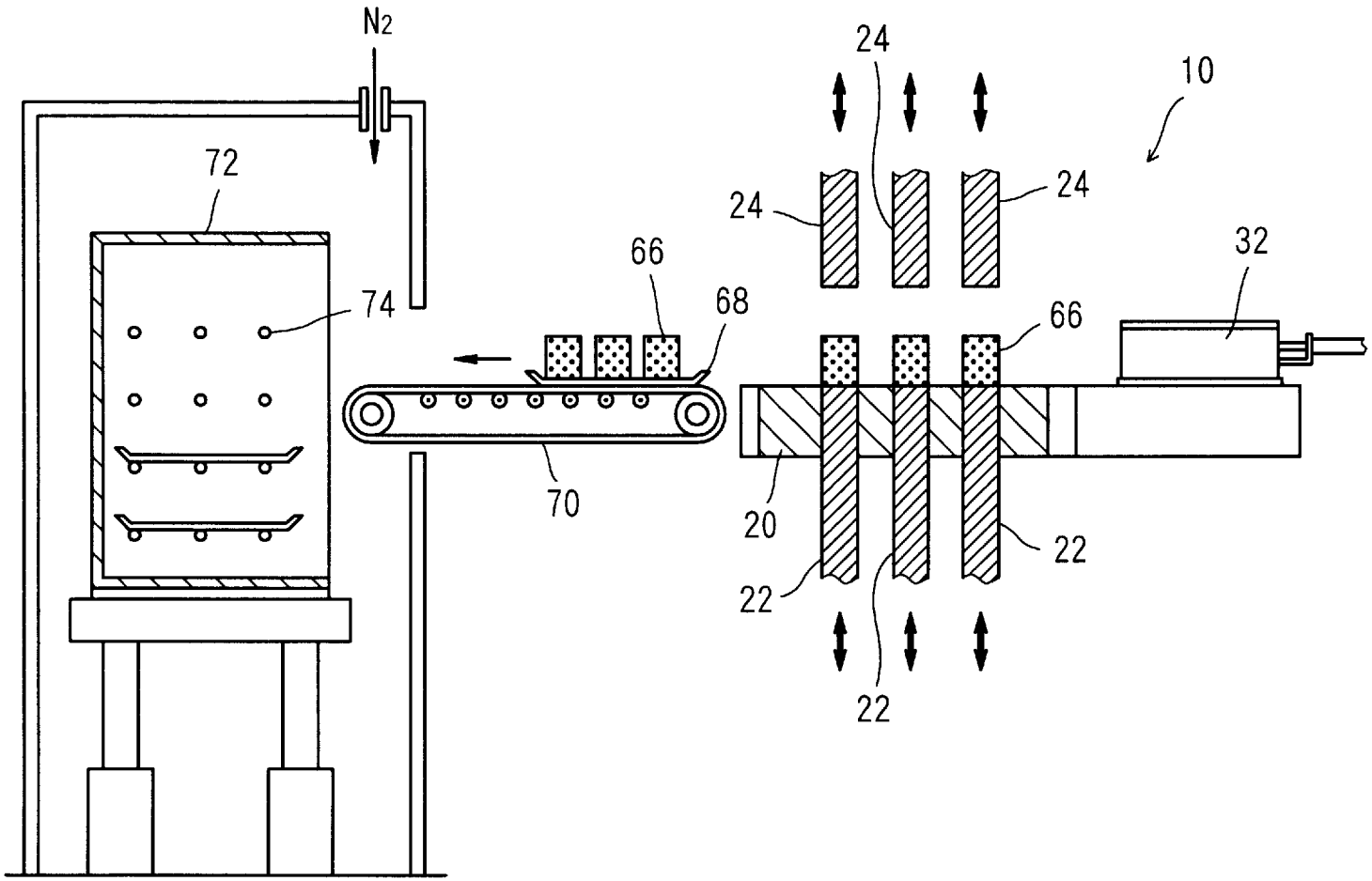
FIG. 6 is a schematic diagram showing the pressing apparatus in FIG. 1 and a surrounding setting.

Reference is made to FIG. 6. Now that the powder m is fed, the upper punches 24 begin to lower, and the coil 29 generates a magnetic field for orientation, which is applied to the powder m in the cavities 28. The upper punches 24 and the lower punches 22 press the powder m in the cavities 28, thereby forming compacts 66 in the cavities 28. Thereafter, the upper punches 24 are raised, and the lower punches 22 are raised to push (to take) the compacts 66 out of the die 20. FIG. 6 shows a state in which the lower punches 22 have held up the compacts 66 entirely above the die 20.

After the pressing operation is complete, the compacts 66 which are elevated by the lower punches 22 are placed onto a sintering plate 68 (thickness: 0.5 mm–3 mm) by an unillustrated transporting robot. The plate 68 is made of a molybdenum material for example. The compacts 66 are transported on the conveyer 70, together with the plate 68, into a sintering case 72 which is placed in a space filled with inert gas atmosphere such as nitrogen atmosphere. The sintering case 72 is preferably made of a thin molybdenum plate (thickness: 1 mm–3 mm approx.).

The sintering case 72 is provided with a plurality of molybdenum rods (supporting rods) 74 extending horizontally. The rods 74 support the plate 68, on which the compacts 66 are placed, generally horizontally in the sintering case 72.

Use of the sintering case 72 as described above allows a plurality of compacts 66 to be sintered efficiently in the sintering furnace while preventing the compacts 66 from being exposed within the furnace during the sintering, making possible to prevent such problems as oxidization of the compacts 66.

Hereinafter, description will cover a method of manufacturing an R-T-(M)-B rare-earth magnet by using the powder feeding apparatus 14.

In order to manufacture an R-T-(M)-B magnet, first, an R—Fe—B alloy is made by using a strip cast process, which is a known method of making an alloy by means of rapid quenching process (quenching speed: not slower than $10^{2}$° C./s and not faster than $10^{4}$° C./s). The strip cast process is disclosed in the U.S. Pat. No. 5,383,978 for example. Specifically, an alloy having a composition comprising 26 weight percent Nd, 5.0 weight percent Dy, 1.0 weight percent B, 0.2 weight percent Al, 0.9 weight percent Co, 0.2 weight percent Cu, with the rest of ingredient being Fe and unavoidable impurities is melted by a high-frequency melting process into a molten. The molten is maintained at 1,350° C., and then quenched on a single roll, yielding a flaky alloy having a thickness of 0.3 mm. Cooling conditions at this time include a roll peripheral speed of about 1 m/s, a cooling rate of 500° C./s, and a sub-cooling of 200° C. for example.

The obtained alloy flake is coarsely pulverized by means of a hydrogen occlusion milling, and then further milled in an nitrogen atmosphere by a jet mill, into a fine alloy powder having an average particle diameter of 3.5 $\mu$m approx. It is preferable that the amount of oxygen in the nitrogen atmosphere should be maintained at a low level, at around 10000 ppm for example. Such a jet mill as the above is disclosed in Japanese Patent Publication (of examined Application for opposition) No. 6-6728. Preferably, concentration of oxidizing gas (such as oxygen and moisture) contained in the atmosphere during the fine milling should be controlled, whereby oxygen content (weight) in the finely milled alloy powder is controlled not greater than 6000 ppm. If the oxygen content in the rare-earth alloy powder is excessive, beyond 6000 ppm, then the magnet contains non-magnetic oxide at a high rate, which deteriorates magnetic characteristic of the resulting sintered magnet.

Next, a lubricant is added to and mixed with the rare-earth alloy powder at a rate of 0.3 weight percent, for example, in a rocking mixer, so that particle surfaces of the alloy powder are coated with the lubricant. Preferably, the lubricant is a fatty acid ester diluted with a petrol solvent. According to the present embodiment, capronic acid methyl can be used as the fatty acid ester, and isoparaffin can be used as the petrol solvent, suitably. Weight ratio of the capronic acid-methyl to isoparaffin is 1:9 for example.

The kind of the lubricant is not limited to the above-mentioned. For example, besides capronic acid methyl, usable fatty ester includes capric acid methyl, lauryl acid methyl, and lauric acid methyl. As for the solvent, isoparaffin is representative but many others can be selected from petrol solvents, as well as naphthene and other solvents. The solvent may be added at a discretionary timing, i.e. before, during or after the fine milling. Further, a solid (dry) lubricant such as zinc stearate can be used together with the liquid lubricant.

Next, the pressing apparatus 10 is used to form compacts from the alloy powder described above.

First, the rare-earth alloy powder is fed in the feeder box 32 of the powder feeding apparatus 14, and then the alloy powder is supplied from the feeder box 32 into the cavities 28 formed in the die 20 of the pressing apparatus 10. By using the powder feeding apparatus 14, the powder can be fed uniformly without forming a bridge for example, in the cavities 28. Next, the rare-earth alloy powder in the cavities 28 is pressed (press formation) within a magnetic field, into compacts of a predetermined shape. The compacts are made to have a density of 4.3 g/cm$^3$ for example. According to the present embodiment, the powder feeding apparatus 14 feeds a predetermined amount of the rare-earth alloy powder uniformly in each of the cavities 28. Therefore, by pressing the rare-earth alloy powder thus fed, compacts having a uniform density can be formed. Further, since the powder feeding apparatus 14 can uniformly feed a plurality of cavities at one time, crack development in the compact during the pressing operation can be prevented and therefore yields can be improved.

Particularly, if the depth of the cavity is not greater than 30 mm, inconsistent feeding of the rare-earth alloy powder into the cavity allows bridge formation by the rare-earth alloy powder, and can increase density inconsistency in the resulting compact. The powder teeing apparatus 14 can feed the powder uniformly even if the cavities are of such a shallow depth.

Thereafter, as shown in FIG. 6, the compacts placed on the sintering plate 68 are encased in a sintering case 72, transported to a sintering apparatus, and then placed in a preparation chamber at an entrance of the sintering apparatus. The preparation chamber is then sealed, and atmosphere inside the preparation chamber is partially vacuumed to 2 Pa approx., in order to prevent oxidization. Next, the sintering case 72 is transported into a de-wax chamber, where a de-wax process (Temperature: 250° C.–600° C., Atmospheric pressure: 2 Pa, Time: 3 hours–6 hours) is performed. The de-wax process allows the lubricant (wax) that coats the particle surfaces of the magnetic powder to evaporate before the sintering process. In order to improve orientation of the magnetic powder at the time of pressing operation, the lubricant is mixed with the magnetic powder before the pressing operation, and is present between the particles of the magnetic powder. During the de-wax process, different gases such as organic gases, vapor and so on are released from the compacts. Therefore, it is preferable that a getter which can absorb these gases should be placed in advance in the sintering case 72.

After completion of the de-wax process, the sintering case 72 is transported into a sintering chamber, where the compacts undergo a sintering process in an argon atmosphere at a temperature of 1000° C. –1100° C. for 2 hours–5 hours approx. During the process, the compacts are sintered while shrinking, into sintered bodies.

During the above process, since the compacts have a uniform density according to the present embodiment, the shrinkage inconsistency of the compacts in magnetically anisotropic directions is favorably small. Therefore, the sintered bodies can be finished into a predetermined size in a reduced working time, making possible to improve productivity.

Thereafter, the sintering case 72 is transported into a cooling chamber, and cooled to a room temperature. The sintered bodies thus cooled are then placed in an aging furnace to undergo a known aging process. The aging process is preformed under such conditions as within an argon atmosphere of 2 Pa approx., at a temperature of 400° C. –600° C. for 3 hours–7 hours. The sintered bodies may be taken out of the sintering case 72 onto a stainless steel mesh container before the aging process.

The sintered bodies of the rare-earth magnet thus manufactured to have a desired magnetic characteristic are then cut and polished into a desired shape. Since the sintered bodies have a favorably small size-inconsistency, working time for shaping operation can be reduced. Thereafter,the shaped magnets undergo surface treatment in order to improve weather resistance as necessary, including formation of a protective coating with such material as Ni and Sn, to be rare-earth magnets as a final product.

It should be noted that the rare-earth magnet manufactured by the method according to the present invention is not limited to the magnet of the composition described above. For example, the rare-earth element R can be provided by a raw material that includes at least one of the following elements: Y, La, Ca, Pr, Nd, Sm, Gd, Tb, Dy, Ho, Er, Tm and Lu. In order to attain a satisfactory level of magnetization however, it is preferable that at least 50 atomic percent of the rare-earth element R is provided by Pr or Nd, or combination of both.

The transition metal element T that can include Fe and Co may only include Fe. However, addition of Co raises Curie temperature and improves heat resistance. Preferably, at least 50 atomic percent of the transition metal element T should be provided by Fe, since the rate of Fe lower than 50 atomic percent decreases saturation magnetism of $Nd_2Fe_{14}B$ type composites.

Addition of B is indispensable in order to allow stable crystallization of the tetragonal $Nd_2Fe_{14}B$ type composites. The amount of B smaller than 4 atomic percent allows crystallization of $R_2T_{17}$ phase, which reduces coercive force, resulting in excessive deformation of a desirable square pattern in demagnetizing curve. For this reason, it is preferable that B should be added at a rate not smaller than 4 atomic percent.

Other elements may be doped in order to further increase magnetic anisotropy of the powder. At least one selected from the following group of elements, Al, Ti, Cu, V, Cr, Ni, Ga, Zr, Nb, Mo, In, Sn, Hf, Ta, W can be preferably used as the doping element. The doping element M is not necessary for obtaining magnetically isotropic powder, but addition of Al, Cu, Ga and so on can increase intrinsic coercive force.

Figure 7:
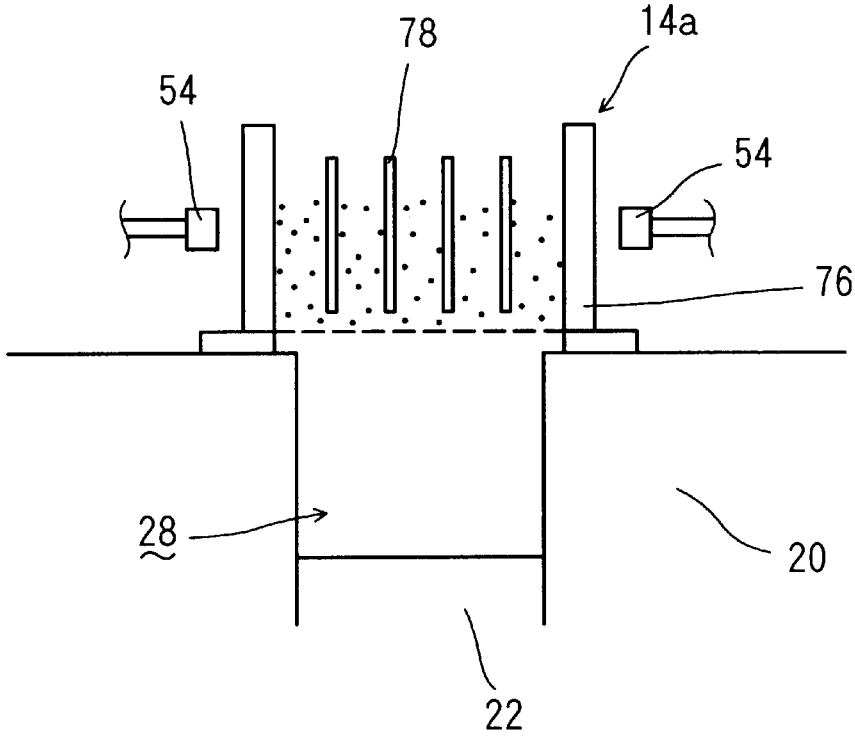
FIG. 7 is a sectional view of a powder container in a powder feeding apparatus according to another embodiment.

Next, reference is made to FIG. 7, and description will cover a powder container 76 used in a powder feeding apparatus 14*a* according to another embodiment. A plurality of partition plates 78 are provided inside the powder container 76. With such a provision as the partition plates 78, when the impactor 54 hits a side wall of the powder container 76, the impulsive force can be transmitted dispersively to the powder m that is partitioned by the partition plates 78 in the powder container 76, making possible to feed the powder m more efficiently. With such an arrangement, the time necessary for the powder feeding into the cavity 28 can be remarkably shortened. Vertical positions (along the height of powder container 76) of the partition plates 78 are adjustable. By adjusting the position of partition plates 78 in accordance with the volume of the powder m held in the powder container 76, the force can be distributed appropriately to the entire mass of the powder.

Figure 8A:
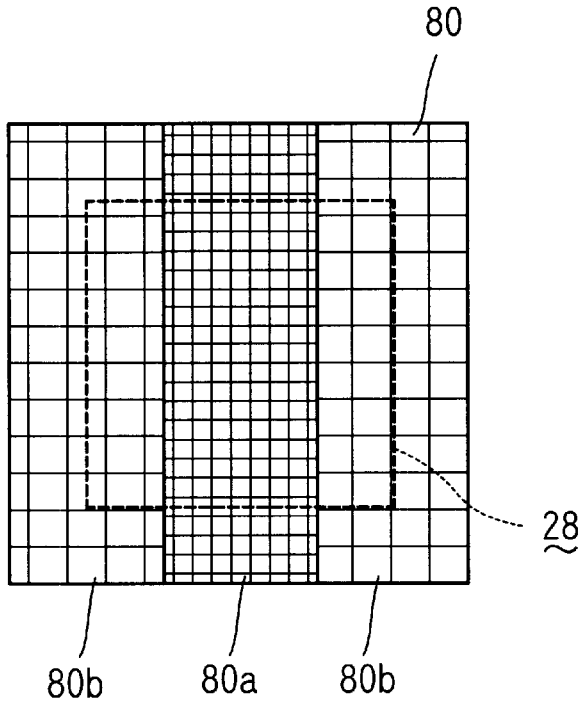
FIG. 8A and FIG. 8B are plan views each showing a variation of the net member.
Figure 8B:
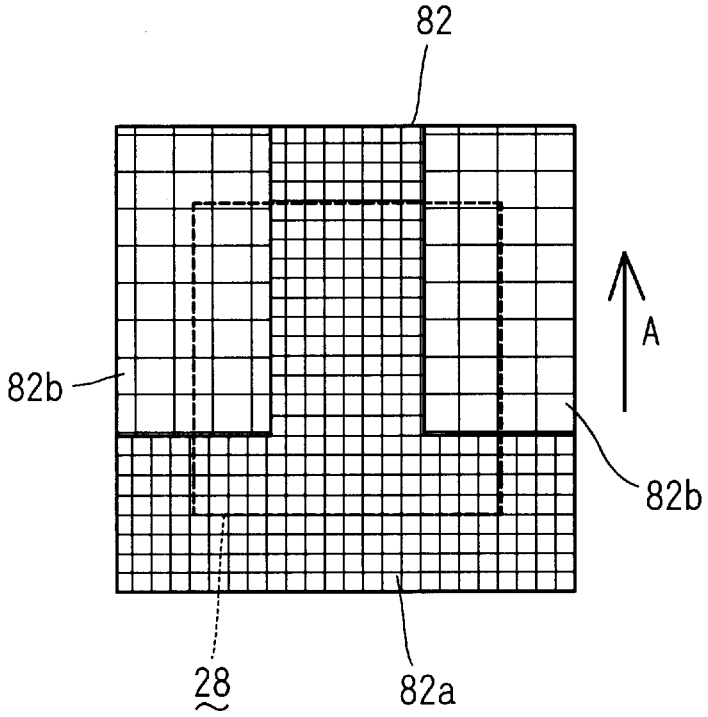

The net member provided at the bottom portion of the powder container may be varied. FIG. 8A and FIG. 8B show such variation as a net member 80 and a net member 82. As shown in FIG. 8A, the net member 80 includes two kinds of net assemblies 80*a* and 80*b* each having a different grid coarseness from each other. Likewise, as shown in FIG. 8B, the net member 82 includes two kinds of net assemblies 82*a* and 82*b* each having a different grid coarseness from each other. By changing the grid coarseness as the above, in accordance with locations in the net member, it becomes possible to control the amount of powder m to be fed into the cavities 28 according to region.

As has been described earlier, sometimes, corner and/or edge regions of the cavity 28 can receive a smaller amount of powder supply than a center region of the cavity 28. In such a case, in order to supply the entire cavity 28 with the powder uniformly, it is preferable to make an arrangement to supply a greater amount of the powder m in the corner and/or edge regions of the cavity 28.

For this reason, according to the net members 80 and 82 in FIG. 8A and FIG. 8B, portions corresponding to the edge regions of the cavity 28 are respectively provided with coarser net assemblies 80*b* and 82*b*, whereas the portions corresponding to the center region are respectively provided with finer net assemblies 80*a* and 82*a*. With such an arrangement, it becomes possible to feed the edge regions of the cavity 28 with a greater amount of powder m than the center region.

Further, according to the net member 82 shown in FIG. 8B, the finer net assembly 82*a* is provided at a rear portion with respect to the moving direction (indicated by an arrow A in the figure) of the net member 82 during the wiping operation which is performed after the powder feeding. The region beneath the finer net assembly 82*a* gets less supply of the powder m. This is because the powder m scattered on the die 20 may be wiped into the edge region of the cavity 28 (the region corresponding to the finer net assembly) during the wiping operation, so the amount of the supply to the region is reduced in advance. Such an arrangement allows the entire cavity 28 to have uniformly fed with an appropriate amount of the powder m upon completion of the wiping.

Table 1 shows a result of experiment conducted to the embodiments of the present invention and a comparative example.

In Embodiment 1, the powder feeding apparatus 14 shown in FIG. 2 was used to feed the cavities 28 with a rare-earth alloy powder, and then a pressing operation was performed to form compacts. In Embodiment 2, the powder feeding apparatus 14*a* shown in FIG. 7 was used to form compacts. In Comparison 1, compacts were formed by using a shaker type powder feeding apparatus disclosed in Japanese Patent Laid-Open No. 2000-248301.

Each of the compacts formed as the above was sintered, and measurements were made to see thickness inconsistency and weight inconsistency of the sintered body. The thickness inconsistency was calculated as follows: First, for each of the sintered bodies, the thickness was measured at nine locations. Then, a difference between a maximum measurement and a minimum measurement of nine measurements was obtained, and the difference was divided by an average of the nine thickness measurements to obtain the thickness inconsistency. Note that the thickness inconsistency value given in Table 1 is an average of the thickness inconsistency values (percent) obtained for 200 sintered bodies. The weight inconsistency was calculated by first obtaining a difference between a maximum weight and a minimum weight of the 200 sintered bodies, and then dividing the difference by an average weight of the 200 sintered bodies. The feed time is a length of time needed for feeding the cavities with a certain amount of the powder.

TABLE 1

| | Method | Feed Time | Weight Inconsistency (R/Av) | Thickness Inconsistency (R/Av) |
|---|---|---|---|---|
| Embodiment 1 | Hitting-type Feeding Apparatus | 12 s | 2.67% | 1.54% |
| Embodiment 2 | Hitting-type Feeding Apparatus plus Partition Plates | 10 s | 2.35% | 1.12% |
| Comparative Example 1 | Shaker-type feeding Apparatus | 15 s | 5.40% | 2.74% |

From Table 1 given above, it is clear that as compared with the shaker-type powder feeding apparatus (Comparative Example 1) disclosed in Japanese Patent Laid-Open No. 2000-248301, the powder feeding apparatuses 14 and 14*a* (Embodiments 1 and 2) shown in FIG. 2 and FIG. 7 respectively can feed more quickly and can decrease dimensional and weight inconsistency of the sintered body.

Figure 9A:
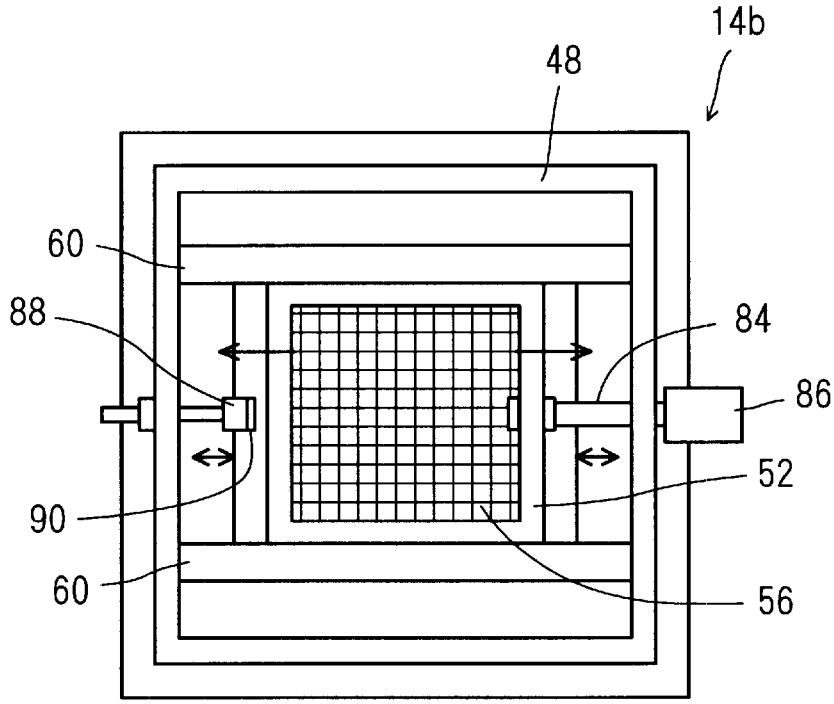
FIG. 9A and FIG. 9B are views each showing a principal portion of a powder feeding apparatus used in still another embodiment.
Figure 9B:
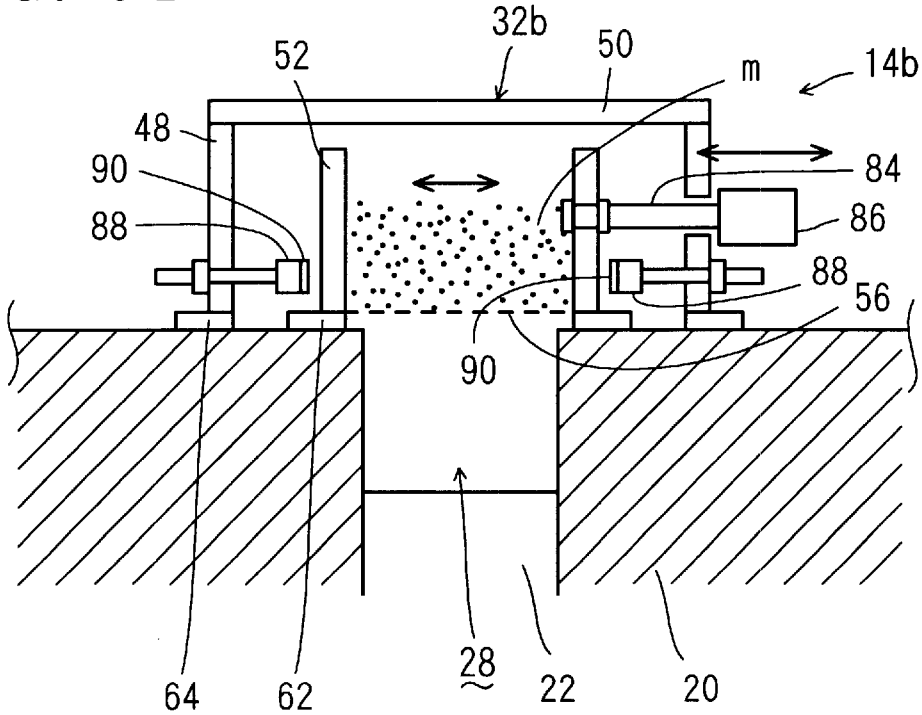
Figure 10:
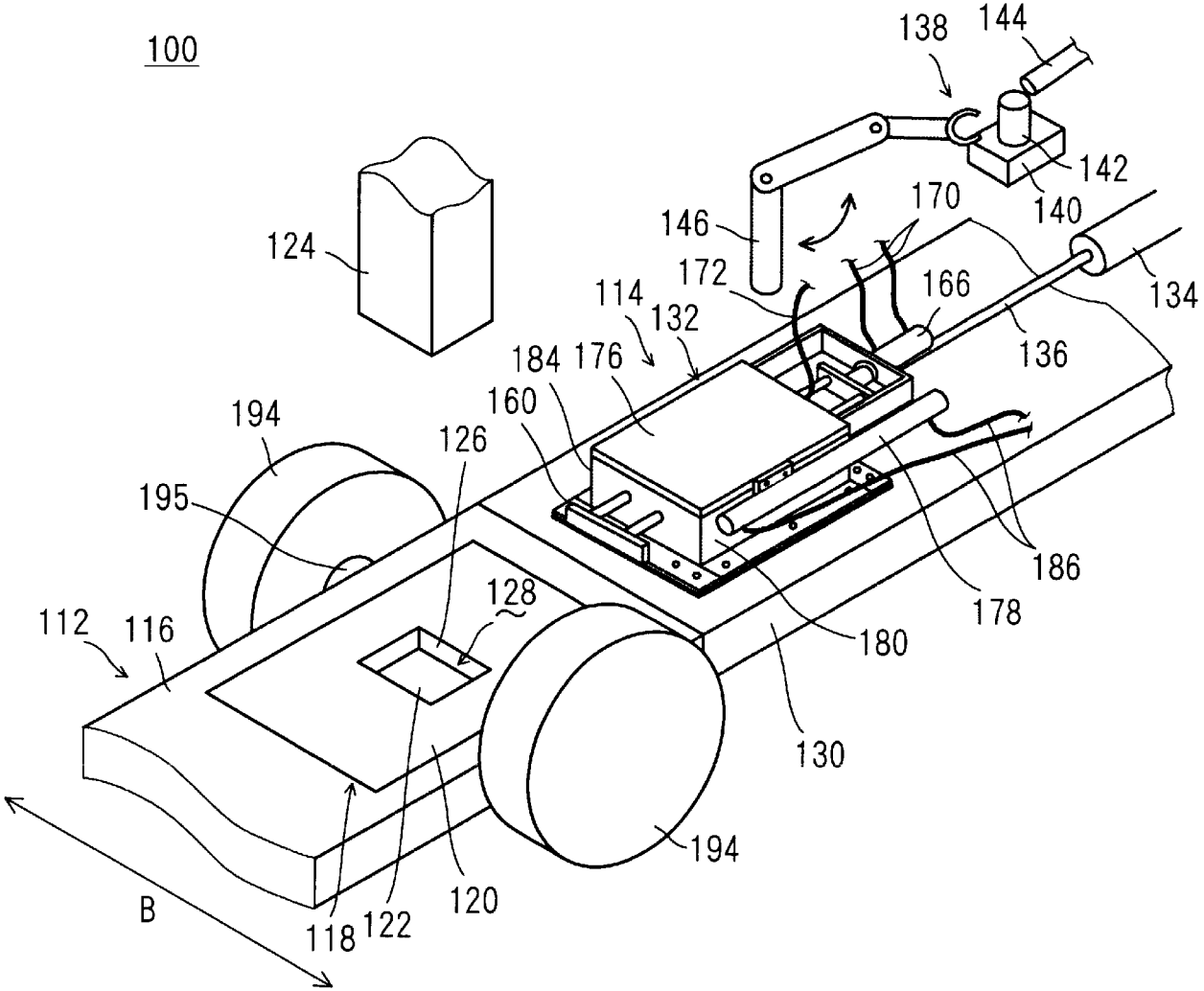
FIG. 10 is a perspective view showing a principal portion of the pressing apparatus according to another embodiment of the present invention.

Next, reference is made to FIG. 9A and FIG. 9B, which show a principal portion of a powder feeding apparatus 14*b* according to another embodiment. The powder feeding apparatus 14*b* comprises a vibration mechanism 84 connected to an upper portion of a powder container 52. The vibration mechanism 84 is connected to a cylinder 86 such as an air cylinder. Further a pair of impactors 88 is attached to the enclosing member 48 so as to hit a lower portion of the powder container 52. Each of the impactors 88 has a tip 90 made, for example, of a hard resin so that the hitting with the powder container 52 does not produce a spark. Other arrangements including mesh size of the net member 56, the distance from the surface of the die 20 to the net member 56 are the same as in the powder feeding apparatus 14 shown in FIG. 2A and FIG. 2B.

According to the powder feeding apparatus 14*b*, the cylinder 86 drives the vibration mechanism 84, and the vibration mechanism 84 vibrates the upper portion of the powder container 52, whereby the impactors 88 are hit against the lower portion of the powder container 52. The powder container 52 is moved in a stroke of 1 mm–15 mm for example.

According to the powder feeding apparatus 14*b*, the vibration mechanism 84 is disposed at an upper portion whereas the impactors 88 are disposed at a lower portion. By such separation, the impactors 88 can be disposed closer to the surface of the die 20, making possible to apply the impact force more uniformly to the opening 56*a* of the powder container 52 which contains the powder m. Therefore, the powder m can be fed more uniformly and stably into the cavity 28.

Further, if the powder m is provided by a very fine powder having, for example, an average particle diameter not greater than 10 $\mu$m, it becomes possible to reduce whirling of the powder m in a feeder box 32*b* out of the powder container 52, making possible to prevent the powder m from being caught by sliding part between the enclosing member 48 and the air cylinder 86 for example.

Further, the powder m fed in the cavity 28 by using the powder feeding apparatus 14*b* can be pressed in the same way as in the embodiment shown in FIG. 1, and then sintered into a sintered magnet. In this way, a sintered magnet having a small inconsistency in size and weight can be obtained.

The powder feeding apparatus 14*b* offers generally the same effects as offered by the Embodiment 2 shown in the above Table 1.

Next, reference is made to FIG. 10 through FIG. 14, and description will cover a pressing apparatus 100 according to another embodiment of the present invention.

The powder pressing apparatus 100 comprises a pressing portion 112 and a powder feeding apparatus 114.

The pressing portion 112 includes a die set 116 and a die tooling 118. The die tooling 118 includes a die 120, a lower punch 122 and an upper punch 124. The die 120 has a saturated magnetism not smaller than 0.05 T and not greater than 1.2 T for example. The die 120 is fitted into the die set 116. The lower punch 122 is disposed so as to be inserted into a die hole 126 from below. The die hole 126 is a through hole running vertically through the die 120. An upper end surface of the lower punch 122 and an inner circumferential surface of the die hole 126 provide a cavity 128 of a variable volume. With this arrangement, the upper punch 124 is inserted into the cavity 128, to press a powder m fed in the cavity 128 into a compact.

The powder feeding apparatus 114 includes a base plate 130 disposed in abutment on the die set 116. On the base plate 130, a feeder box 132 is disposed. The feeder box 132 is moved by a cylinder rod 136 of a cylinder 134 which is driven e.g. hydraulically or pneumatically (or by an electric servo motor), in a reciprocating pattern between a predetermined position on the die 120 and a stand-by position. Near the stand-by position of the feeder box 132, there is provided a replenishing apparatus 138 for replenishing the feeder box 132 with the powder m. The replenishing apparatus 138 includes a weighing scale 140, a feeder cup 142, a vibrating trough 144 and a robot 146. The operation of the replenishing apparatus 138 is the same as of the replenishing apparatus 38 described earlier, and therefore repetitive description will not be made.

Figure 11:
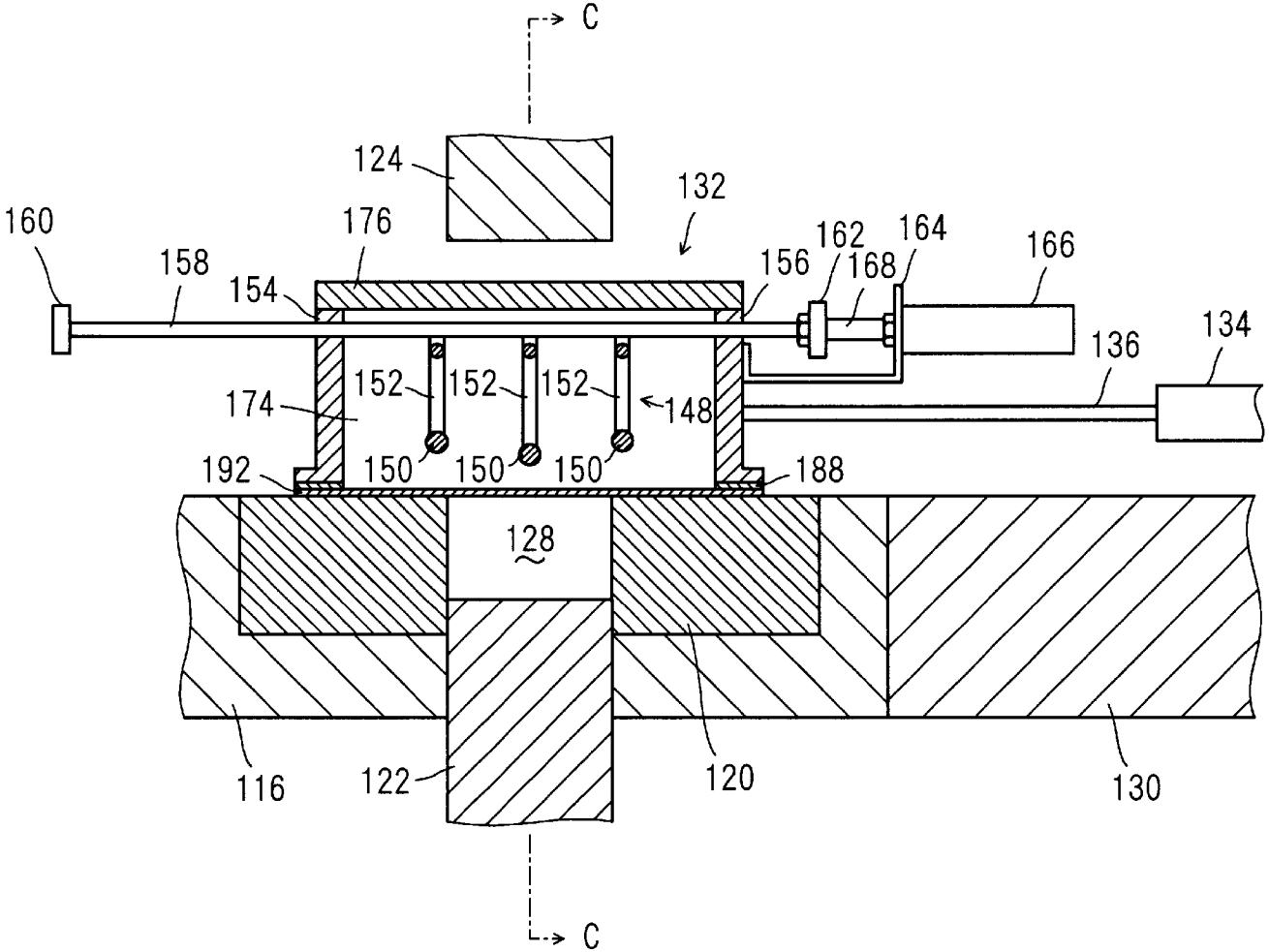
FIG. 11 is a side view showing a section of a principal portion of the embodiment in FIG. 10.
Figure 12:
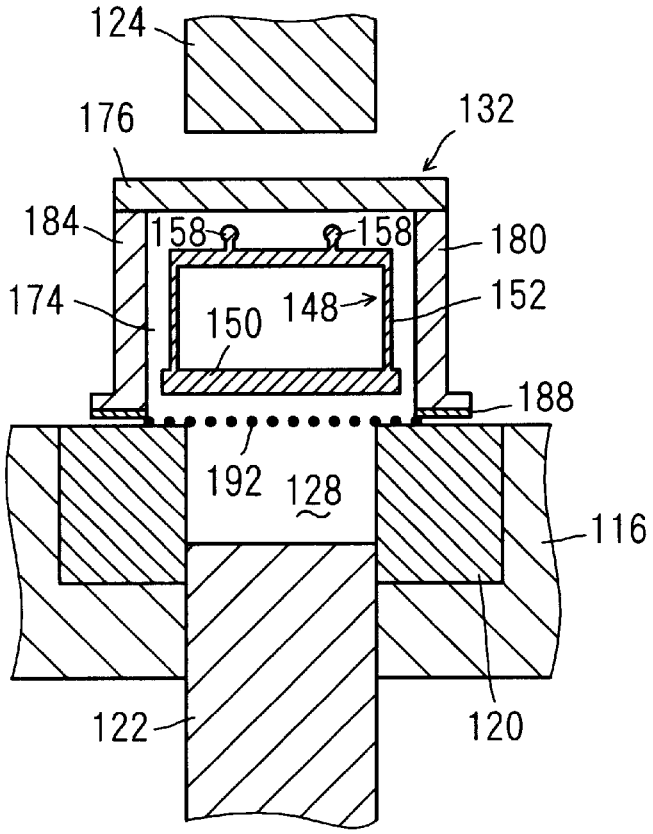
FIG. 12 is an end view taken in line C—C (shown in FIG. 11), showing a principal portion of the embodiment in FIG. 10.
Figure 13:
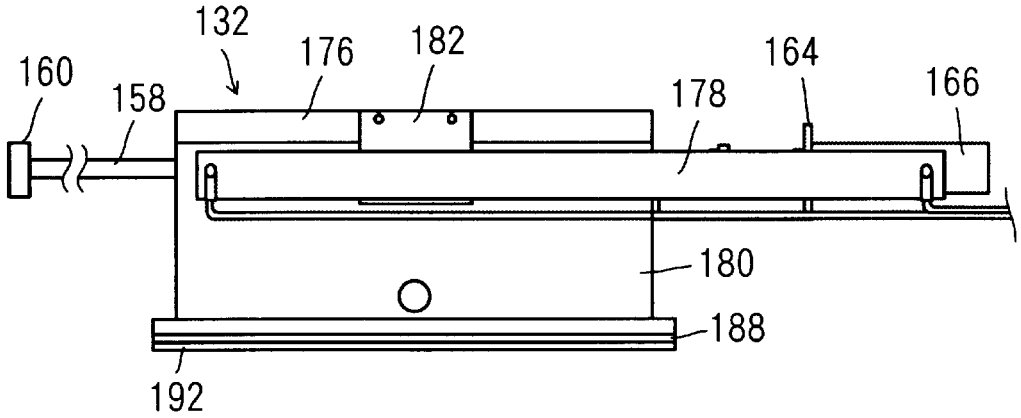
FIG. 13 is a side view showing a principal portion of a powder feeding apparatus used in the embodiment in FIG. 10.

As shown in FIG. 11 and FIG. 12, a shaker (may also be called agitator) 148 is provided inside the feeder box 132. The shaker 148 includes a plurality of rod members 150 disposed in parallel with an upper surface of the die 120 and with an upper surface of the base plate 130, and a plurality of generally U-shaped supporting members 152. Each of the rod members 150 is made for example of a bar material having a circular section of a diameter not smaller than 3 mm and not greater than 10 mm. The bar material may be a square bar. The rod members 150 and the supporting members 152 are each made of a stainless steel (SUS 304) for example. According to the present embodiment, three rod members 150 and three supporting members 152 are used. Each of the rod members 150 has its two end portions connected with one of the supporting members 152, so that three sets of generally rectangular frame-like structure are provided. Two supporting rods 158 extend in parallel with each other, penetrating two side walls 154, 156, which are the walls across moving directions of the feeder box 132. Each of the supporting members 152 has its upper portion connected to the two supporting rods 158, whereby the supporting members 152 and the rod members 150 are fastened. Each supporting rod 158 has two ends respectively fastened by e.g. screws to connecting members 160, 162 provided by e.g. strip-like pieces, and is connected with each other. The side wall 156 has an outer surface provided with a fixing hardware 164, to which an air cylinder 166 is fixed. The air cylinder 166 has a cylinder shaft 168 fastened to the connecting member 162. With this structure, the air cylinder 166 has two ends each supplied with air through an air supply tube 170. This causes the cylinder shaft 168 to reciprocate, thereby reciprocating the shaker 148. The rate of reciprocation is determined in accordance with the volume of powder to be fed.

Further, a gas supply pipe 172 is provided at a center upper portion of the side wall 156 of the feeder box 132, for supplying an inert gas such as nitrogen gas into the feeder box 132. The inert gas such as nitrogen gas is supplied into the feeder box 132 at a higher pressure than the normal atmospheric pressure in order to maintain the inside of the feeder box 132 filled with the inert gas. Because of this arrangement,even if friction is generated between the feeder box 132 and the powder by the reciprocating movement of the shaker 148, this does not cause catching fire. Likewise, the feeder box 132 is moved, with the powder caught between a bottom surface of the feeder box 132 and the base plate 130, but friction in this movement does not cause ignition either. Further, movement of the feeder box 132 generates friction among powder particles in the feeder box 132, but this does not lead to ignition of the powder, either.

Further, a powder containing portion 174 of the feeder box 132 is maintained air tight by a lid 176. When replenishing the powder m, in order to open an upper surface of the powder containing portion 174, the lid 176 must be moved toward the cylinder 166 (in a rightward direction as in FIG. 13). For this purpose, an air cylinder 178 which opens the lid 176 is provided on a side wall 180. The lid 176 and the air cylinder 178 are connected with each other by a hardware 182 and fastened together by screws. In order to maintain the inside of the feeder box 132 filled with the inert gas, the lid 176 is disposed to cover the powder containing portion 174 of the feeder box 132 at normal times, and is moved toward the cylinder 166 only when the powder is replenished. The side wall 180 of the feeder box 132 is opposed by a side wall 184, which is provided with guide means (not illustrated) so that the lid 176 can move smoothly during the open/close operation by the air cylinder 178. With this arrangement, the air cylinder 178 has two ends each supplied with air through an air supply tube 186. The air drives the cylinder shaft (not illustrated), thereby opening and closing the lid 176.

The feeder box 132 has a bottom surface provided with a plate member 188. The plate member 188, made for example of a fluororesin, has a thickness of 5 mm and is fastened by screws. The feeder box 132 slides on the base plate 130 via the plate member 188, which prevents the powder m from being caught between the feeder box 132 and the base plate 130.

Figure 14:
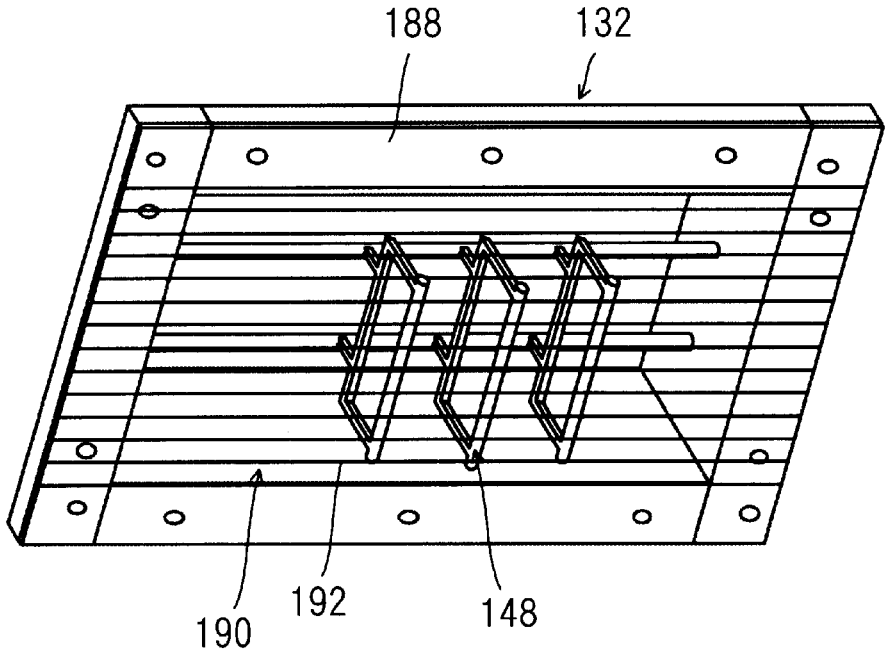
FIG. 14 is a perspective view showing a feeder box provided with a shaker and linear members.

In addition, as shown in FIG. 14, a plurality of linear members 192 are disposed at an opening 190 of the feeder box 132, in parallel with a direction of movement of the feeder box 132. The opening 190 is larger than an upper opening of the cavity 128. The linear members 192 are made of a nonmagnetic metal wire having a diameter of 0.15 mm approx. The linear members 192 are spaced at an interval not smaller than 2 mm and not greater than 4 mm. The rod members 150 are spaced from the linear members 192 by a distance not smaller than 0.5 mm and not greater than 10 mm. The diameter of the linear members 192 and the distance between the rod members 150 and the linear members 192 are adjusted in accordance with the size of the cavity 128.

Further, a pair of magnetic field generating coils 194 is provided to sandwich the die set 116, as orienting means. At a center of each coil 194, a core 195 made of permendur for example is provided. By energizing the magnetic field generating coils 194, an orienting magnetic field having a strength for example of 1.2 T is applied to the powder m in the cavity 128, in a direction indicated by Arrow B, and the powder m is oriented.

Description will now cover an operation of the pressing apparatus 100.

An inert gas such as nitrogen gas is supplied through the gas supply pipe 172 to the inside of the powder containing portion 174 of the feeder box 132. Under this state, the lid 176 of the feeder box 132 is opened, and the robot 146 supplies the powder containing portion 174 with a predetermined amount of powder m from the feeder cup 142. After supplying the powder m, the lid 176 is closed so as to maintain the inside atmosphere of the powder containing portion 174 filled with the inert gas. The supply of the inert gas into the powder containing portion 174 is continuous, not only when the feeder box 132 is moving above the cavity 128, in order to prevent the powder from spontaneous ignition. The inert gas may alternatively be argon or helium gas.

Under the above condition, the air cylinder 134 is activated to move the feeder box 132 to above the cavity 128 of the die 120. Then, the rod members 150 in the feeder box 132 are reciprocated 5 times–15 times for example in horizontal directions to allow the powder in the feeder box 132 to drop through a screen of linear members 192 into the cavity 128, in the inert gas atmosphere. The above process allows supplying of the powder into the cavity 128 at a remarkably uniform feeding density, without any risk of ignition. During the process, the powder in the feeder box 132 does not drop naturally when the feeder box 132 comes above the cavity 128. When the shaker 148 begins its pushing action, the powder begins to pass through the screen of the linear members 192, being placed in the cavity 128 at a density suitable for the orientation.

After the powder m is fed in the cavity 128, the feeder box 132 is receded, and then the upper punch 124 is lowered. Under this state, while the magnetic field generating coils 194 generate the orienting magnetic field, the powder m in the cavity 128 is pressed. During this process, the feeder box 132 which has been receded is replenished with the powder m. By repeating the above described cycle, the pressing operation of the powder m is performed continually.

Figure 15A:
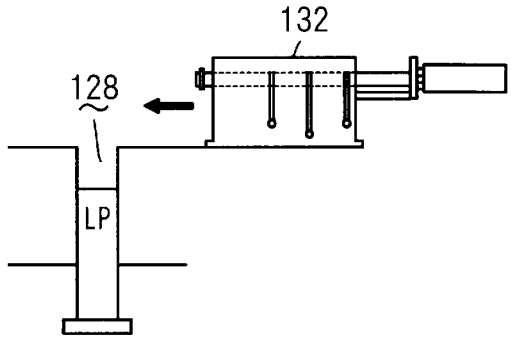
FIG. 15A through FIG. 15D are views illustrating a powder feeding operation according to the embodiment in FIG. 10.
Figure 15B:
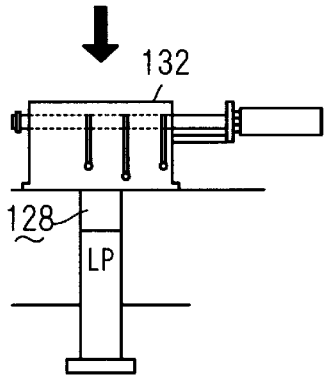
Figure 15C:
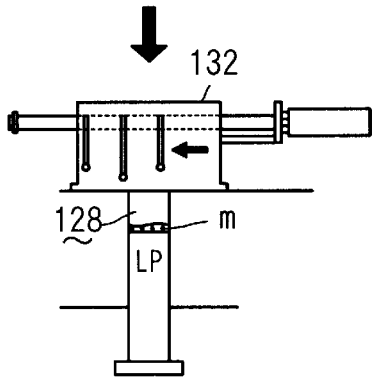
Figure 15D:
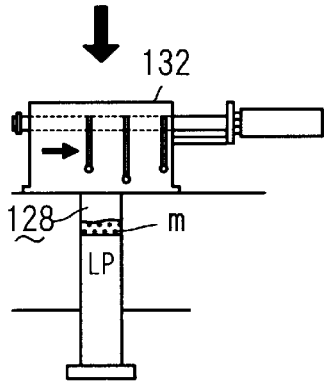
Figure 16:
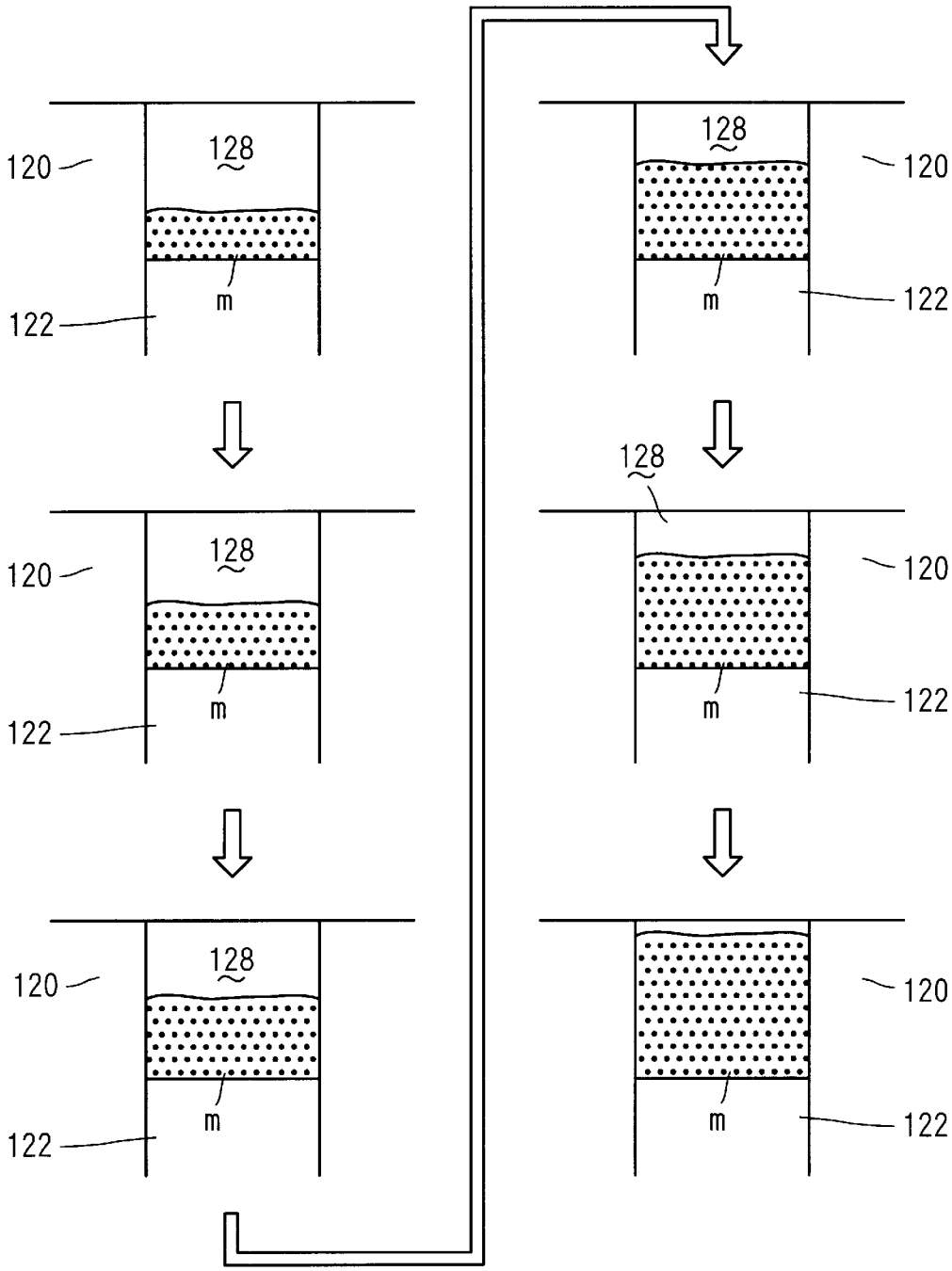
FIG. 16 is a diagram illustrating state changes in the powder feeding according to the embodiment in FIG. 10.

According to the pressing apparatus 100, even when the feeder box 132 is moved toward the cavity 128 as shown in FIG. 15A, and even after the feeder box 132 has moved above the cavity 128 as shown in FIG. 15B, the powder m does not fall into the cavity 128 since the powder m is in the state of bridging due to the linear members 192 provided at the opening 190 of the feeder box 132. Thereafter, as shown in FIG. 15C and FIG. 15D, each reciprocating stroke of the shaker 148 in the feeder box 132 allows a constant amount of the powder m to be placed in the cavity 128 generally uniformly. Specifically, the powder m is fed in the cavity 128 as illustrated in FIG. 16, and the powder m can be fed uniformly in the cavity 128 at a natural feeding density (1.7 $g/cm^3$–2.0 $g/cm^3$ for example). As described, since the powder m is not fed at a high density, the powder particles can easily move, allowing a desired orientation by an orienting magnetic field of a relatively low strength. This makes possible to prevent manufacturing cost from increasing. Further, since the feeding can be made generally uniformly, a product having a superb magnetic characteristic can be obtained by orienting the powder m in the cavity 128.

It should be noted that preferably the reciprocating operation of the shaker 148 should allow at least one of the rod members 150 to move from one side above the cavity 128 to the other side thereof. This setting allows more uniform feeding of the powder m into the cavity 128.

By setting the distance between the rod members 150 and the linear members 192 to be not smaller than 0.5 mm and not greater than 10 mm, flow of the powder m near the linear members 192 is assisted, making possible to smoothly feed the powder m into the cavity 128 at a density suitable for the orientation. If the distance between the rod members 150 and the linear members 192 is smaller than 0.5 mm, the powder m between the rod members 150 and the linear members 192 develops intense friction with the rod members 150 and the linear members 192, and the friction can cut the fine liner members 192. On the other hand, if the distance between the two members exceeds 10 mm, it becomes impossible to let the powder pass through the screen of linear members 192 by the pushing action of the rod members 150, and therefore a feeding suitable for orientation cannot be achieved.

Further, feeding by means of natural gravitational fall performed by the pressing apparatus 100 can improve flowability of the powder m at the time of magnetic orientation. Therefore, even if the powder m is made by a rapid quenching process, particles of the powder m can move easily in the cavity 128. This makes possible to easily orient the powder m in a given magnetic direction, and to form a magnet having a high magnetic anisotropy for example.

Further, the interval between the linear members 192 should preferably be 2 mm–12 mm. If the interval is smaller than 2 mm, it becomes impossible to push the powder m in by the moving action of the rod members 150. If the interval is grater than 12 mm, the feeding density becomes higher than the natural feeding density, since the bridging force above the cavity 128 is weak.

Further, by pressing the powder m which is uniformly fed in the cavity 128, a compact of a highly uniform density can be obtained. Also, crack and fracture development and deformation due to inconsistent density can be prevented.

The compact is then transported to a sintering furnace and sintered in an argon atmosphere at a temperature of 1050° C. for two hours, and then aged in an argon atmosphere at a temperature of 600° C. for an hour, to be the sintered magnet. In this stage of sintered magnet, again, rate of defective products due to cracking and/or fracturing is decreased, and rate of after-sintering deformation is also decreased. Therefore, machining margin reserved for dimension correction can be decreased, which makes possible to improve yield in manufacturing process, to improve productivity of the sintered magnet, and to manufacture a sintered magnet having a favorable magnetic characteristic.

Further, by performing the pressing operation using the die 120 which has the saturated magnetism of not smaller than 0.05 T and not greater than 1.2 T, a uniform distribution of magnetic flux density is provided in the cavity 128, and, it becomes possible to manufacture a sintered magnet without deformation.

Next, description will cover an experiment. The experiment was conducted to the pressing apparatus 100 and the pressing apparatus disclosed in Japanese Patent Laid-Open No.2000-248301 (conventional apparatus), and results were compared.

The experiment was conducted under the following conditions:

TABLE 2

| Experiment conditions | |
|---|---|
| Compacts | Size: 80 mm × 52.2 mm × 20 mm<br>Number of compacts made per press: one<br>Raw material: Nd-Fe-B alloy powder<br>Produced by a strip cast process<br>(Average particle diameter: 2 μm–5 μm)<br>Capronic acid methyl was added as a lubricant.<br>Pressed density: 4.1 g/cm$^3$<br>Feeding density:<br>Pressing apparatus 10; 1.8 g/cm$^3$<br>Conventional Apparatus; 2.3 g/cm$^3$ |
| Feeder Box | Shaking: 10 reciprocations in parallel with the die surface (in both apparatuses)<br>Size of rod members: 3 mm diameter<br>Material of rod members: stainless steel<br>Size of linear members: 0.15 mm diameter<br>Material of linear members: copper<br>Spacing between liner members: 2 mm<br>Spacing between rod and linear members: 2 mm–4 mm |
| Pressing | Pressing method: Pressing in a magnetic field<br>Pressing was made while applying a magnetic field perpendicularly to the pressing direction.<br>Die hole size: 80 mm × 52.2 mm<br>Depth of powder feeding: 50 mm |
| Measurement | Formed compacts were sintered, aged, cut and then measured. Measurement was made for only one sintered magnet which was sliced out of the center portion. Measurement was made on a main surface of the sintered magnet. |

Figures 17A, 17B:
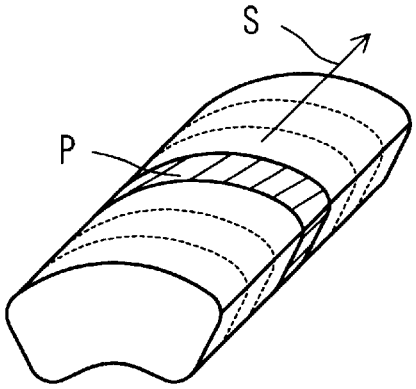

In this experiment, a compact as shown in FIG. 17A, which can be used in manufacturing a voice coil motor for example, was manufactured. The size of the compact was 80 mm×52.2 mm×20 mm. One compact was made per cycle of the pressing operation. Pressing was performed in a magnetic field, and the pressing was made while applying the magnetic field perpendicularly to the pressing direction (indicated by Arrow S in FIG. 17A). The feeder box was a single-cavity feeding type. The shaker was reciprocated ten times in horizontal directions. The powder was a rare-earth alloy powder (Nd—Fe—B alloy powder). A strip cast process was used to produce the alloy powder having an average particle diameter of not smaller than 2 μm and not greater than 5 μm. A lubricant (capronic acid methyl) was added to the alloy powder. The compact shown in FIG. 17A was then sintered, aged, and then cut into sintered magnets. Of these sintered magnets, magnetic characteristic was measured for only one sintered magnet obtained from the center portion (corresponding to the shaded piece P in FIG. 17A). The measurement was made on a main surface of the sintered magnet.

It was found that the conventional apparatus fed the cavity at a feeding density of 2.3 g/cm$^3$ approx. On the other hand, the pressing apparatus 100 according to the present invention fed at a desired feeding density of 1.8 g/cm$^3$ approx. Therefore, as understood from FIG. 17B, the sintered magnet obtained from the compact manufactured by the pressing apparatus 100 has an improved residual magnetic flux density Br and a maximum energy product (BH)max than the sintered magnet obtained from the compact manufactured by the conventional apparatus.

It should be noted that the pressing apparatus 100 may use the die 20 shown in FIG. 1, which is formed with a plurality of cavities 28.

Figure 18:
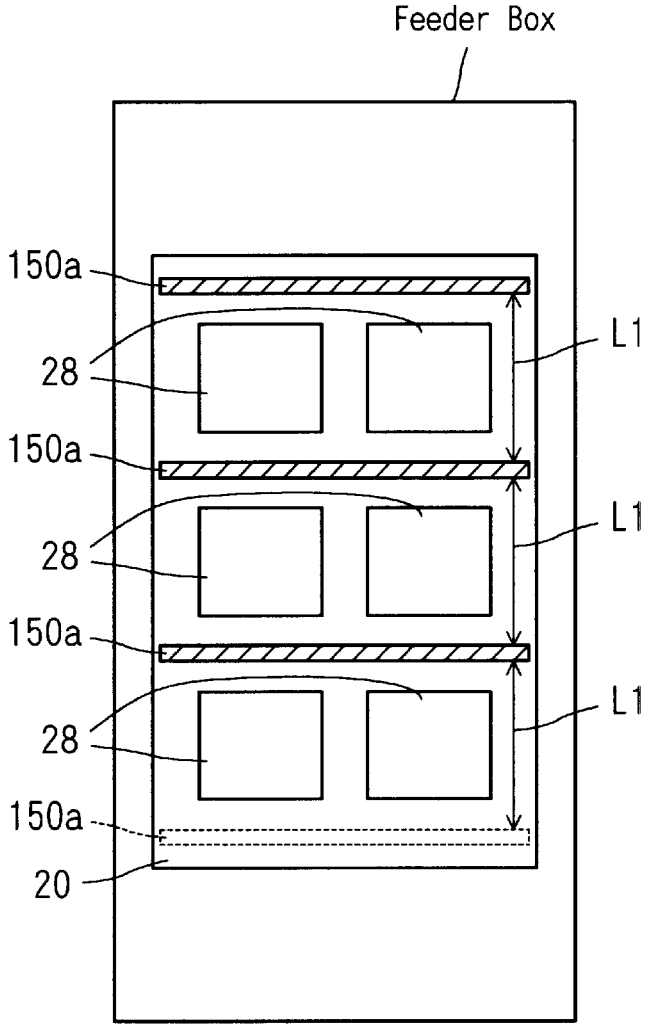
FIG. 18 is a schematic diagram showing another embodiment of the present invention.

In this case, as shown in FIG. 18, an arrangement may be made so that each of the cavities 28 is fed with the powder m by one of the rod members 150*a*. In such an arrangement, preferably, a mutually adjacent pair of the rod members 150*a* should be spaced from each other by a distance generally equal to a center-to-center distance between the corresponding rows of the cavities 28. In the above arrangement, in order for each rod member 150*a* to move from one side to the other side above the corresponding row of cavities 28, the rod member 150*a* should only move in a stroke L1 which is generally as wide as the cavity. Further, in the shaking action of the rod members 150*a*, none of the rod members 150*a* stops above an unrelated row of the cavities 28, making possible to prevent non-uniform powder feeding. Further, weight inconsistency in the powder feeding can be decreased if a distance between each rod member 150*a* and the die 20 is set equally.

Figure 19:
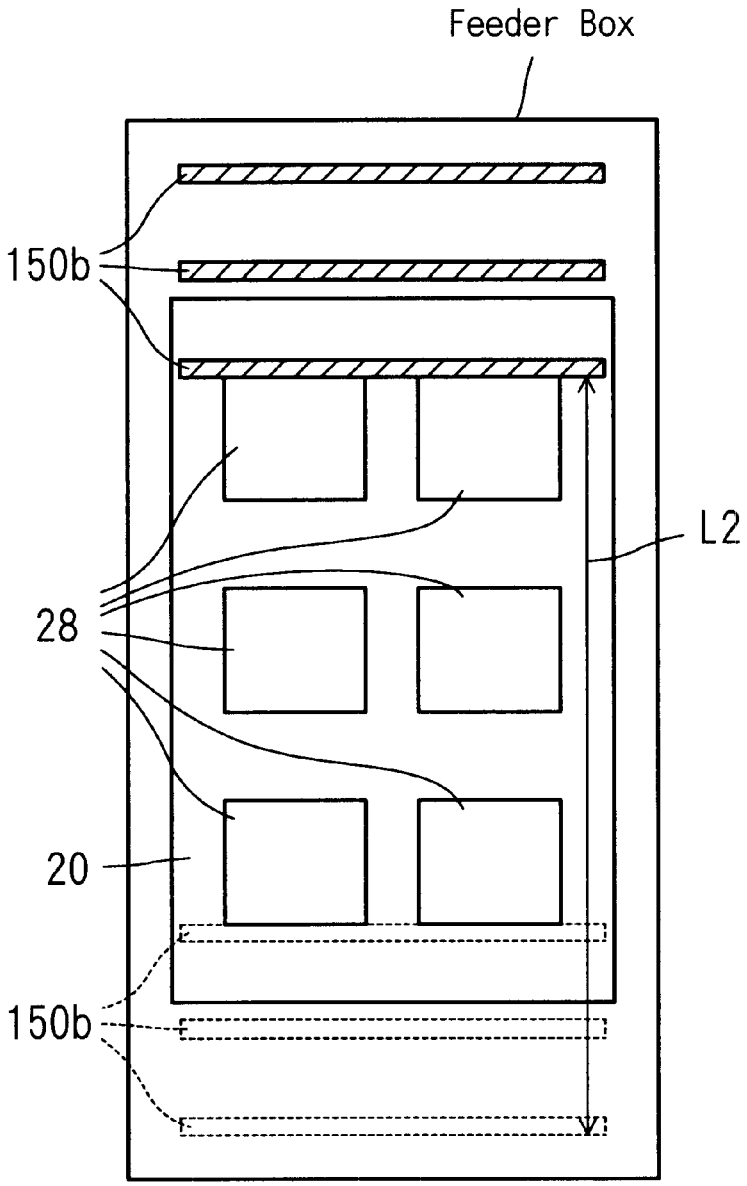
FIG. 19 is a schematic diagram showing still another embodiment of the present invention.

Further, as shown in FIG. 19, each of the cavities 28 may be fed with the powder m by all of the rod members 150*b* (three rod members according to this embodiment: The number of the rod members can be one or more). In this case, a stroke L2 of the rod members 150*b* is set to allow all of the rod members 150*b* to move from one side to the other side above all the rows of cavities. In this case again, weight inconsistency in the powder feeding can be decreased if a distance between each rod member 150*b* and the die 20 is set equally.

Next, another experiment will be described.

In this experiment, a die formed with two cavities in a row in a direction of the feeder box movement was used to form two compacts (s intered bodies) per pressing cycle. The sintered body was for manufacture of a VCM (voice coil motor). During the pressing operation, a pressing direction of the powder was perpendicular to an orienting direction of the powder. The sintered bodies were manufactured respectively by using the powder feeding apparatus 114 shown in FIG. 10 and the conventional powder feeding apparatus disclosed in Japanese Patent Laid-Open No. 2000-248301, and comparison was made in terms of the weight distribution. Experiment conditions were as follows: The size and weight of the sintered body to be manufactured were set as 58.63 mm×36.9 mm×18.13 mm, and 217.7 g. The linear members used were provided by a wire of a 0.6 mm diameter made into a metal net having a sieve aperture of 6 mesh. A total of 300 blocks of compacts (sintered bodies) were manufactured in 150 continual stroke cycles of feeding and pressing.

Figure 20A:
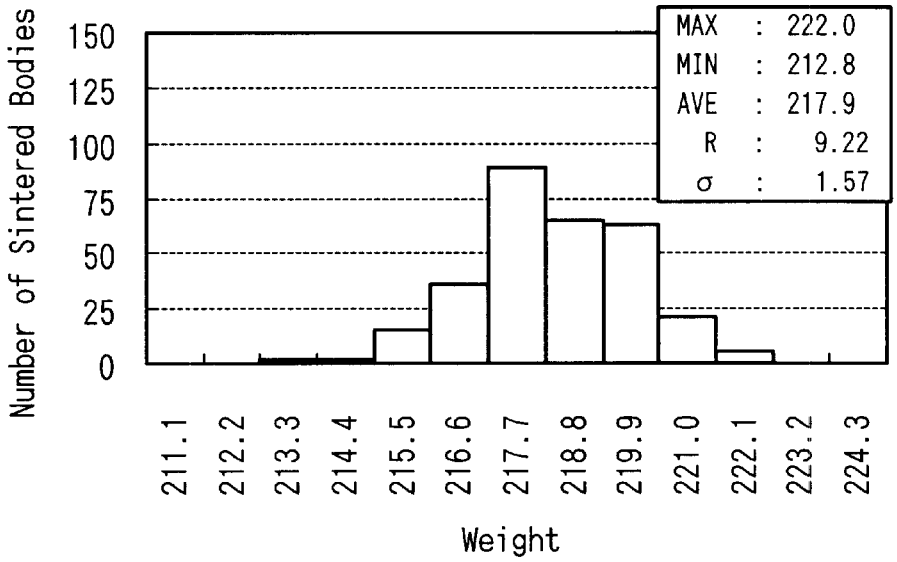
FIG. 20A and FIG. 20B are graphs showing a result of another experiment.
Figure 20B:
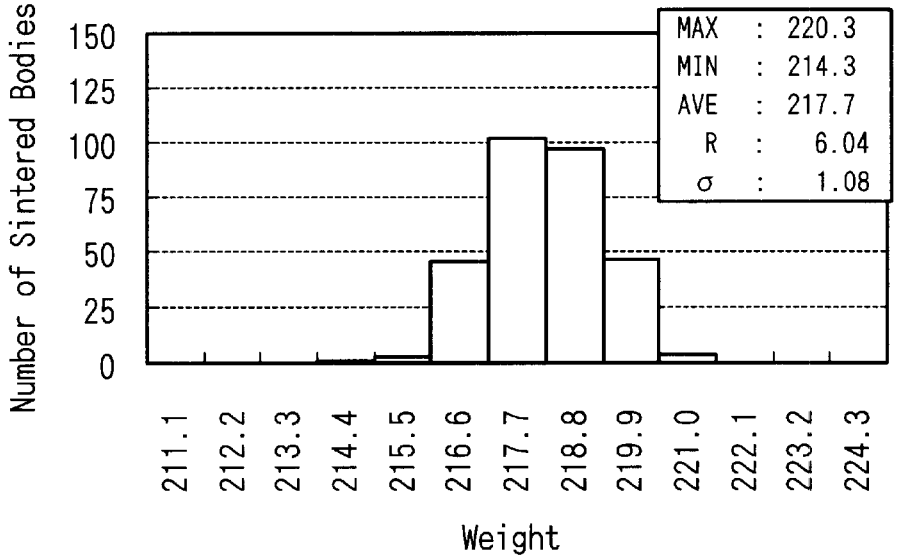
Figure 21A:
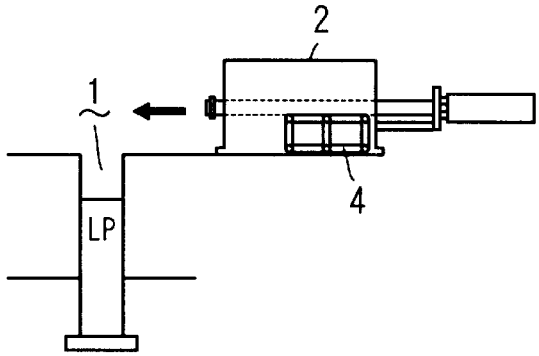
FIG. 21A through FIG. 21D are diagrams illustrating a powder feeding operation performed by a conventional apparatus.
Figure 21B:
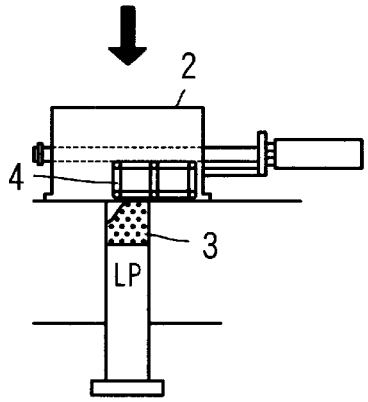
Figure 21C:
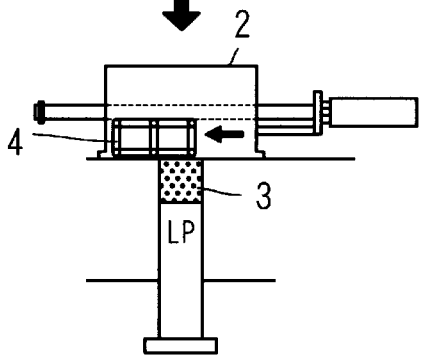
Figure 21D:
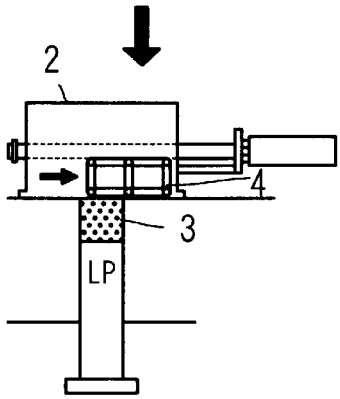
Figure 22:
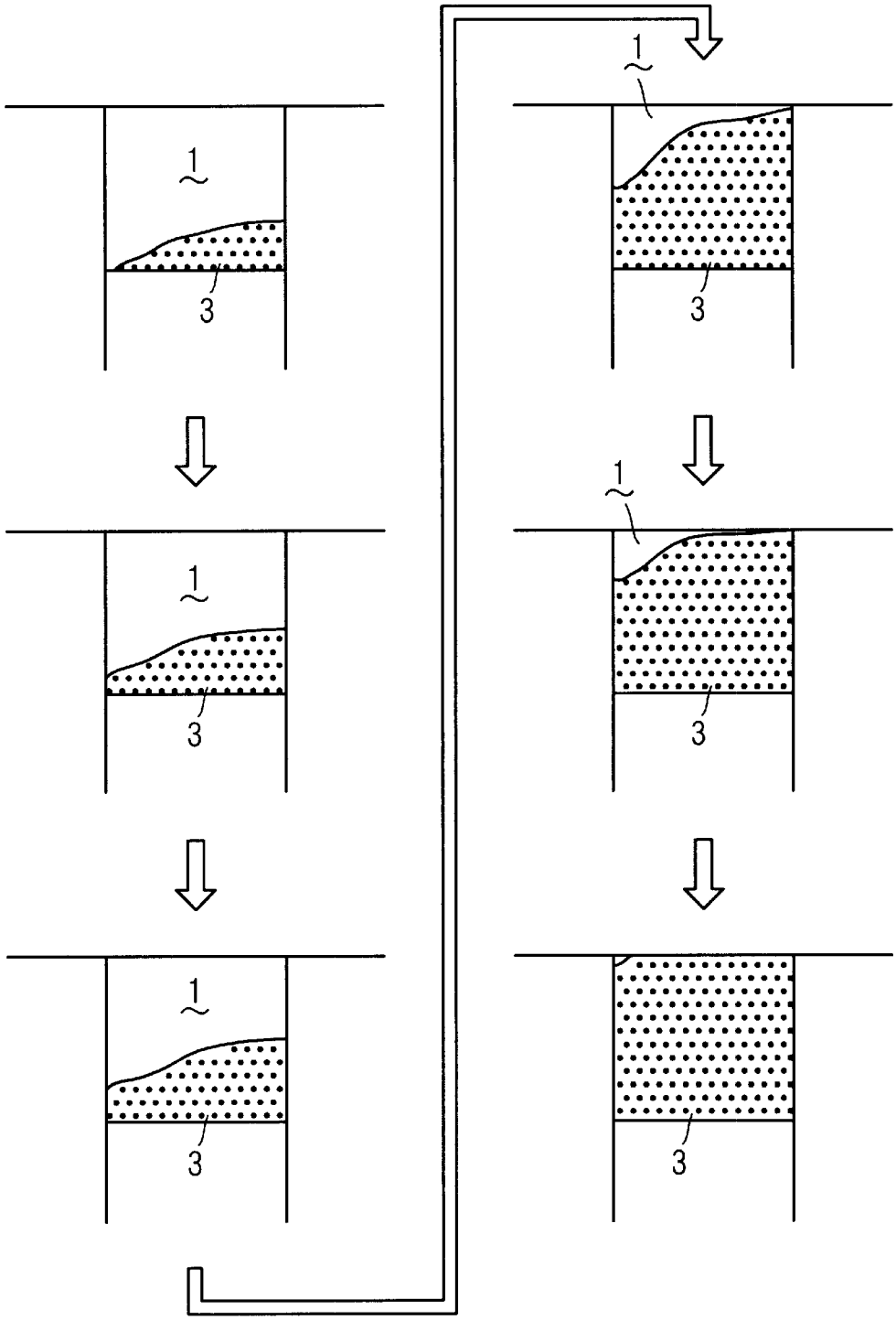
FIG. 22 is a diagram illustrating state changes in the powder feeding according to the conventional apparatus.

A result of the experiment is shown in FIG. 20A and FIG. 20B. The weight inconsistency was improved by about 30%, from 9.22 gas achieved by the conventional apparatus to 6.04 g, proving improvement in feeding accuracy. As exemplified, use of the shaker 148 and the linear members 192 in the pressing apparatus formed with a plurality of cavities can also improve the weight inconsistency in feeding to the cavities, as compared with the conventional apparatus.

It should be noted that the die 120 should preferably be a low-magnetic metal die disclosed in Japanese Patent Laid-Open No. 2000-248301, or a metal die including a nonmagnetic die and highly magnetic yokes disposed on die hole side surfaces which are perpendicular to a direction of magnetic field application. By using such a metal die, it becomes possible to uniformalize magnetic flux density in the cavity 128, and therefore to prevent the obtained compact from deforming when sintered.

The linear members 192 may be provided perpendicularly to the direction of movement of the feeder box 132 or may be made like a net, at the opening 190 of the feeder box 132.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A powder feeding apparatus for feeding a powder into a cavity formed in a die, comprising:

a container including a bottom portion provided with a powder holding portion formed with a plurality of openings capable of allowing the powder to pass through; and an impactor capable of hitting against the container;

wherein the impactor is hit against the container to give an impulsive force to the container, thereby feeding the powder contained in the container into the cavity via the openings.

2. The apparatus according to claim 1, further comprising a vibrating mechanism connected to an upper portion of the container, wherein the impactor is provided so as to hit against a lower portion of the container, the vibrating mechanism vibrating an upper portion of the container, thereby allowing the impactor to hit against the lower portion of the container.

3. The apparatus according to claim 1, wherein the powder holding portion is formed of a net having a mesh size of 2–14.

4. The apparatus according to claim 1, wherein the powder holding portion is formed of a net having a mesh size of 2–8.

5. The apparatus according to claim 1, wherein the powder holding portion is provided at a height smaller than 2.0 mm from a surface of the die.

6. The apparatus according to claim 1, wherein the powder holding portion is provided at a height smaller than 1.0 mm from the surface of the die.

7. The apparatus according to claim 1, wherein the container can move when the impulsive force is given to the container by the hitting of the impactor against the container.

8. The apparatus according to claim 1, comprising a plurality of the impactors disposed outside of the container in an opposing relationship, with the container in between.

9. The apparatus according to claim 1, further comprising a partition plate provided inside the container.

10. The apparatus according to claim 1, wherein a size of the openings provided in the powder holding portion is in accordance with a location of the opening.

11. The apparatus according to claim 1, wherein the powder is provided by a rare-earth alloy powder.

12. The apparatus according to claim 11, wherein a lubricant is added to the powder.

13. A sintered magnet manufacturing method comprising:

a first step of applying an impulsive force by an impactor to a container which includes a bottom portion provided with a powder holding portion formed with a plurality of openings capable of allowing a powder to pass through, thereby feeding the powder contained in the container via the openings into a cavity formed in a die;

a second step of forming a compact by pressing the powder fed in the cavity; and a third step of manufacturing a sintered magnet by sintering the compact.

14. The method according to claim 13, wherein an upper portion of the container is vibrated, thereby applying the impulsive force to a lower portion of the container, in the first step.

15. The method according to claim 13, wherein the powder is a rare-earth alloy powder, the method further comprising a step of adding a lubricant to the rare-earth alloy powder before the first step.

16. A powder feeding apparatus for feeding a powder into a cavity formed in a die, comprising a container for containing the powder, including a bottom portion provided with a net, wherein the net is provided at a height smaller than 2.0 mm from a surface of the die.

17. A powder feeding apparatus for feeding a powder into a cavity formed in a die, comprising a container including a bottom portion provided with a net, wherein a size of an opening of the net varies in accordance with a location of the opening.

18. A pressing apparatus comprising:

the powder feeding apparatus according to any one of claims 1 through 12, 16 or 17; and pressing means which presses the powder fed in the cavity by the powder feeding apparatus.

19. A powder feeding apparatus for feeding a powder into a cavity formed in a die comprising:

a feeder box movable to above the cavity, including a bottom portion formed with an opening, and for containing the powder;

a rod member provided inside the feeder box for positioning the powder for the downward movement;

a linear member provided at the opening of the feeder box; and orienting means which orients the powder fed from the feeder box in the cavity.

20. The apparatus according to claim 19, wherein the rod member is spaced from the linear member by a distance not smaller than 0.5 mm and not greater than 10 mm.

21. A pressing apparatus comprising:

the powder feeding apparatus according to claim 19; and pressing means which presses the powder fed in the cavity by the powder feeding apparatus.

22. A powder feeding method for feeding a powder into a cavity formed in a die, the method comprising:

a step of moving a feeder box to above the cavity of the die, with the feeder box containing the powder, being provided inside thereof with a rod member movable in a horizontal direction, and having an opening provided with a linear member;

a step of feeding the powder into the cavity while moving the rod member in the horizontal direction within the feeder box, when the feeder box is above the cavity; and a step of orienting the powder by applying an orienting magnetic field to the powder in the cavity.

23. The method according to claim 22, wherein the powder is made by a rapid quenching process.

24. The method according to claim 22, wherein the interval between the linear members is not smaller than 2 mm and not greater than 12 mm.

25. A sintered magnet manufacturing method comprising:

a step of obtaining a compact by pressing a powder in a cavity, the powder being fed by the method according to claim 22 or 23; and a step of manufacturing a sintered magnet by sintering the compact.

* * * * *